US011074872B2

(12) United States Patent
Guan et al.

(10) Patent No.: US 11,074,872 B2
(45) Date of Patent: Jul. 27, 2021

(54) BACKLIGHT DRIVING CIRCUIT, BACKLIGHT MODULE, DISPLAY DEVICE AND BACKLIGHT DRIVING METHOD

(71) Applicant: BOE TECHNOLOGY GROUP CO., LTD., Beijing (CN)

(72) Inventors: Enhui Guan, Beijing (CN); Ran Duan, Beijing (CN); Lihua Geng, Beijing (CN); Xianzhen Li, Beijing (CN); Qingguo Yang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/887,536

(22) Filed: May 29, 2020

(65) Prior Publication Data

US 2021/0035508 A1 Feb. 4, 2021

(30) Foreign Application Priority Data

Jul. 29, 2019 (CN) ..... 201910689568.1

(51) Int. Cl.
*G09G 3/34* (2006.01)

(52) U.S. Cl.
CPC ..... *G09G 3/3426* (2013.01); *G09G 2310/08* (2013.01); *G09G 2320/064* (2013.01)

(58) Field of Classification Search
None
See application file for complete search history.

(56) References Cited

U.S. PATENT DOCUMENTS

2008/0136353 A1* 6/2008 Hsu ..... G09G 3/3406 315/307
2010/0110097 A1* 5/2010 Nam ..... H05B 45/37 345/589
2010/0301764 A1 12/2010 Liu
(Continued)

FOREIGN PATENT DOCUMENTS

CN 1710964 A 12/2005
CN 101572978 A 11/2009
(Continued)

OTHER PUBLICATIONS

Office Action dated Jun. 2, 2020 in corresponding Chinese Application No. 201910689568.1, with English translation.
(Continued)

*Primary Examiner* — Matthew Yeung
(74) *Attorney, Agent, or Firm* — McDermott Will and Emery LLP

(57) ABSTRACT

A backlight driving circuit includes a pulse width modulator, at least one time-delay sub-circuit and a driving sub-circuit. The pulse width modulator is configured to transmit a control signal including a plurality of pulses. The at least one time-delay sub-circuit is configured to delay at least one pulse of the control signal from the pulse width modulator that is transmitted to the at least one time-delay sub-circuit by a set time. The driving sub-circuit is coupled to the at least one time-delay sub-circuit, and the driving sub-circuit is configured to drive at least one of a plurality of light-emitting devices in a backlight module to be turned on or off according to a control signal from the at least one time-delay sub-circuit obtained after the at least one pulse is delayed.

14 Claims, 15 Drawing Sheets

(56) References Cited

U.S. PATENT DOCUMENTS

| | | | | |
|---|---|---|---|---|
| 2011/0164069 | A1 | 7/2011 | Thompson et al. | |
| 2012/0326628 | A1* | 12/2012 | Fukutoku | G09G 3/342 315/294 |
| 2014/0306873 | A1* | 10/2014 | Yamashita | G09G 3/3426 345/102 |
| 2019/0132915 | A1* | 5/2019 | Xie | H05B 45/37 |

FOREIGN PATENT DOCUMENTS

| | | | |
|---|---|---|---|
| CN | 101902854 | A | 12/2010 |
| CN | 102142811 | A | 8/2011 |
| CN | 102216975 | A | 10/2011 |
| CN | 102354484 | A | 2/2012 |
| CN | 104779917 | A | 7/2015 |
| CN | 105845094 | A | 8/2016 |
| CN | 109754763 | A | 5/2019 |
| JP | H043112 | A | 1/1992 |

OTHER PUBLICATIONS

Office Action dated Sep. 14, 2020 in corresponding Chinese Application No. 201910689568.1, with English translation.

* cited by examiner

BACKLIGHT DRIVING CIRCUIT, BACKLIGHT MODULE, DISPLAY DEVICE AND BACKLIGHT DRIVING METHOD

CROSS-REFERENCE TO RELATED APPLICATION

This application claims priority to Chinese Patent Application No. 201910689568.1, filed on Jul. 29, 2019, which is incorporated herein by reference in its entirety.

TECHNICAL FIELD

The present disclosure relates to the field of display technologies, and in particular, to a backlight driving circuit, a backlight module, a display device and a backlight driving method.

BACKGROUND

Currently, in a large-sized and high-brightness display device, a direct-type backlight module, for example, may be used to improve the brightness of the display device. The direct-type backlight module generally includes a plurality of light-emitting diodes (LEDs), and brightness of the backlight module may be controlled in a partitioned manner by a local dimming technique.

SUMMARY

In one aspect, a backlight driving circuit is provided. The backlight driving circuit includes a pulse width modulator, at least one time-delay sub-circuit and a driving sub-circuit. The driving sub-circuit is coupled to the at least one time-delay sub-circuit. The pulse width modulator is configured to transmit a control signal including a plurality of pulses. The at least one time-delay sub-circuit is configured to delay at least one pulse of the control signal from the pulse width modulator that is transmitted to the at least one time-delay sub-circuit by a set time. The driving sub-circuit is configured to drive at least one of a plurality of light-emitting devices in a backlight module to be turned on or off according to a control signal from the at least one time-delay sub-circuit obtained after the at least one pulse is delayed.

In some embodiments, the at least one time-delay sub-circuit includes a plurality of time-delay sub-circuits coupled in sequence. Except for a last time-delay sub-circuit, each of the plurality of time-delay sub-circuits includes an input terminal, a first output terminal and a second output terminal. The last time-delay sub-circuit includes: an input terminal and a second output terminal. An input terminal of a first time-delay sub-circuit is coupled to the pulse width modulator. In any two adjacent time-delay sub-circuits, a first output terminal of a former time-delay sub-circuit is coupled to an input terminal of a latter time-delay sub-circuit. The second output terminal of each time-delay sub-circuit is coupled to the driving sub-circuit.

In some embodiments, the last time-delay sub-circuit further includes a first output terminal.

In some embodiments, the backlight driving circuit further includes a sampling sub-circuit and a comparison sub-circuit. The sampling sub-circuit is coupled to the pulse width modulator. The comparison sub-circuit is coupled to the sampling sub-circuit and the input terminal of the first time-delay sub-circuit. The sampling sub-circuit is configured to collect the control signal from the pulse width modulator. The comparison sub-circuit is configured to receive the control signal collected by the sampling sub-circuit, to determine whether widths of any two adjacent pulses in the control signal are the same, and to transmit a latter pulse in the two adjacent pulses to the input terminal of the first time-delay sub-circuit in a case where it is determined that the widths of the two adjacent pulses are the same.

In some embodiments, the comparison sub-circuit is further coupled to the driving sub-circuit. The comparison sub-circuit includes a comparison unit and a storage unit. The comparison unit includes a first input terminal, a second input terminal, a first output terminal and a second output terminal. The first input terminal of the comparison unit is coupled to the sampling sub-circuit, the second input terminal of the comparison unit is coupled to the storage unit, the first output terminal of the comparison unit is coupled to the driving sub-circuit and the storage unit, and the second output terminal of the comparison unit is coupled to the first time-delay sub-circuit and the storage unit.

The comparison unit is configured to: by the first input terminal of the comparison unit, receive the control signal collected by the sampling sub-circuit, by the second input terminal of the comparison unit, receive a pulse previous to a current pulse in the control signal that has been stored in the storage unit, and determine whether a width of the current pulse is the same as a width of of the pulse previous to the current pulse in the control signal. If not, the comparison unit is further configured to output the current pulse by the first output terminal of the comparison unit. If so, the comparison unit is further configured to output the current pulse by the second output terminal of the comparison unit. The storage unit is configured to sequentially store pulses of a control signal output from the first output terminal or the second output terminal of the comparison unit, and to make a latter pulse to be stored replace a former pulse that has been stored.

In some embodiments, the driving sub-circuit includes a plurality of current conversion units each coupled to one of the plurality of time-delay sub-circuits. Each current conversion unit includes a first input terminal, a second input terminal and an output terminal. The first input terminal of the current conversion unit is coupled to the first output terminal of the comparison unit, the second input terminal of the current conversion unit is coupled to a second output terminal of a corresponding time-delay sub-circuit, and the output terminal of the current conversion unit is coupled to the at least one of the plurality of light-emitting devices.

In some embodiments, the current conversion unit includes a direct current-direct current (DC-DC) conversion circuit. Or, the current conversion unit includes an alternating current-direct current (AC-DC) conversion circuit. Or, the current conversion unit includes a direct current-alternating current (DC-AC) conversion circuit. Or, the current conversion unit includes an alternating current-alternating current (AC-AC) conversion circuit.

In some embodiments, in a case where the current conversion unit includes the DC-DC conversion circuit, delay times of all the time-delay sub-circuits are the same, and a sum of the delay times of all the time-delay sub-circuits is less than or equal to a reciprocal of an operating frequency of the DC-DC conversion circuit.

In another aspect, a backlight module is provided. The backlight module includes the backlight driving circuit according to the above embodiments and a plurality of light-emitting devices. The plurality of light-emitting devices are coupled to the driving sub-circuit in the backlight driving circuit.

The driving sub-circuit includes a plurality of current conversion units each including an output terminal. The plurality of light emitting devices includes a plurality of groups each including at least one light emitting device. The output terminal of each current conversion unit is coupled to a corresponding group.

In yet another aspect, a display device is provided. The display device includes a display panel and the backlight module according to the above embodiments that is disposed at a side of the display panel.

In yet another aspect, a backlight driving method is provided. The method is applied to the backlight driving circuit according to the above embodiments. The method includes: transmitting, by the pulse width modulator, a control signal including a plurality of pulses; delaying, by the at least one time-delay sub-circuit, at least one pulse of the control signal from the pulse width modulator by a set time; and driving, by the driving sub-circuit, at least one of the plurality of light-emitting devices in the backlight module to be turned on or off according to a control signal from the at least one time-delay sub-circuit obtained after the at least one pulse is delayed.

In some embodiments, the at least one time-delay sub-circuit includes a plurality of time-delay sub-circuits coupled in sequence. Except for a last time-delay sub-circuit, each of the plurality of time-delay sub-circuits includes an input terminal, a first output terminal and a second output terminal. The last time-delay sub-circuit includes an input terminal and a second output terminal. Delaying, by the at least one time-delay sub-circuit, at least one pulse of the control signal from the pulse width modulator by a set time includes: receiving, by an input terminal of a first time-delay sub-circuit, the control signal from the pulse width modulator; transmitting, by a first input terminal of a former time-delay sub-circuit in any two adjacent time-delay sub-circuits, a control signal obtained after at least one pulse is delayed by the former time-delay sub-circuit to an input terminal of a latter time-delay sub-circuit; and transmitting, by the second output terminal of each time-delay sub-circuit, the control signal obtained after the at least one pulse is delayed by a corresponding time-delay sub-circuit to the driving sub-circuit.

In some embodiments, the backlight driving circuit further includes a sampling sub-circuit and a comparison sub-circuit. The method further includes: collecting, by the sampling sub-circuit, the control signal including the plurality of pulses from the pulse width modulator; and receiving, by the comparison sub-circuit, the control signal collected by the sampling sub-circuit, and determining, by the comparison sub-circuit, whether widths of any two adjacent pulses in the control signal are the same; and if so, transmitting, by the comparison sub-circuit, a latter pulse in the two adjacent pulses to the input terminal of the first time-delay sub-circuit.

In some embodiments, the comparison sub-circuit includes a comparison unit and a storage unit, and the comparison unit includes a first input terminal, a second input terminal, a first output terminal and a second output terminal. Receiving, by the comparison sub-circuit, the control signal collected by the sampling sub-circuit, and determining, by the comparison sub-circuit, whether widths of any two adjacent pulses in the control signal are the same; and if so, transmitting, by the comparison sub-circuit, a latter pulse in the two adjacent pulses to the input terminal of the first time-delay sub-circuit includes: receiving, by the first input terminal of the comparison unit, the control signal collected by the sampling sub-circuit; receiving, by the second input terminal of the comparison unit, a pulse previous to a current pulse in the control signal that has been stored in the storage unit; determining, by the comparison unit, whether a width of the current pulse is the same as a width of the pulse previous to the current pulse in the control signal; if so, transmitting, by the second output terminal of the comparison unit, the current pulse to the input terminal of the first time-delay sub-circuit; and storing, by the storage unit, the current pulse output by the comparison unit, and deleting, by the storage unit, the pulse previous to the current pulse that has been stored.

In some embodiments, the driving sub-circuit includes a plurality of current conversion units each coupled to one of the plurality of time-delay sub-circuits, and each current conversion unit includes a first input terminal, a second input terminal and an output terminal. The method further includes: in a case where the comparison unit determines that the width of the current pulse is the same as the width of the pulse previous to the current pulse in the control signal, transmitting, by the second output terminal of the comparison unit, the current pulse to the input terminal of the first time-delay sub-circuit; delaying, by each time-delay sub-circuit, the current pulse sequentially, transmitting, by a first output terminal of a former time-delay sub-circuit, the delayed current pulse to an input terminal of a latter time-delay sub-circuit, and delaying, by the latter time-delay sub-circuit, the delayed current pulse again, a delay time of each time-delay sub-circuit being the same; transmitting, by the second output terminal of each time-delay sub-circuit, a pulse that is delayed by different time to a second input terminal of a corresponding current conversion unit; and transmitting, by the output terminal of each current conversion unit, a pulse from a corresponding time-delay sub-circuit to a corresponding light-emitting device in the plurality of light-emitting devices, so as to drive the corresponding light-emitting device to be turned on or off, wherein different current conversion units drive different light-emitting devices in the plurality of light-emitting devices to be turned on or off.

In some embodiments, receiving, by the comparison sub-circuit, the control signal collected by the sampling sub-circuit, and determining, by the comparison sub-circuit, whether widths of any two adjacent pulses in the control signal are the same further includes: in a case where the comparison unit determines that the width of the current pulse is different from the width of the pulse previous to the current pulse in the control signal, transmitting, by the first output terminal of the comparison unit, the current pulse to the driving sub-circuit.

In some embodiments, the driving sub-circuit includes a plurality of current conversion units each coupled to one of the plurality of time-delay sub-circuits, and each current conversion unit includes a first input terminal and an output terminal. The method further includes: in the case where the comparison unit determines that the width of the current pulse is different from the width of the pulse previous to the current pulse in the control signal, transmitting, by the first output terminal of the comparison unit, the current pulse to the first input terminal of each current conversion unit; and transmitting, by the output terminal of each current conversion unit, the current pulse from the comparison unit to a corresponding light-emitting device in the plurality of light-emitting devices, so as to drive the corresponding light-emitting device to be turned on or off.

BRIEF DESCRIPTION OF THE DRAWINGS

In order to describe technical solutions in the embodiments of the present disclosure more clearly, accompanying drawings to be used in some embodiments of the present disclosure will be introduced briefly. However, the accompanying drawings to be described below are merely accompanying drawings of some embodiments of the present disclosure, and a person of ordinary skill in the art may obtain other drawings according to these drawings. In addition, the accompanying drawings in the following description may be regarded as schematic diagrams, and are not limitations on actual sizes of products, an actual process of a method and actual timings of signals that the embodiments of the present disclosure relate to.

DETAILED DESCRIPTION

Technical solutions in some embodiments of the present disclosure will be described clearly and completely below in combination with accompanying drawings. However, the described embodiments are merely some but not all embodiments of the present disclosure. All other embodiments obtained on a basis of the embodiments of the present disclosure by a person of ordinary skill in the art shall be included in the protection scope of the present disclosure.

Unless the context requires otherwise, the term "comprise/include" and other forms thereof such as the third-person singular form "comprises/includes" and the present participle form "comprising/including" in the description and the claims are construed as open and inclusive, i.e., "inclusive, but not limited to". In the description, the terms such as "one embodiment", "some embodiments", "exemplary embodiments", "example", "specific example", or "some examples" are intended to indicate that specific features, structures, materials or characteristics related to the embodiment(s) or the example(s) are included in at least one embodiment or example of the present disclosure. Schematic representations of the above terms do not necessarily refer to the same embodiment(s) or example(s). In addition, the specific features, structures, materials or characteristics may be included in any one or more embodiments/examples in any suitable manner.

The terms such as "first" and "second" are used for descriptive purposes only, and are not to be construed as indicating or implying the relative importance or implicitly indicating the number of indicated technical features below. Thus, features defined as "first" and "second" may explicitly or implicitly include one or more of the features. In the description of the embodiments of the present disclosure, the term "a/the plurality of" means two or more unless otherwise specified.

In the description of some embodiments, the terms such as "coupled" and "connected" and their extensions may be used. For example, the term "connected" may be used in the description of some embodiments to indicate that two or more components are in direct physical or electrical contact with each other. For another example, the term "coupled" may be used in the description of some embodiments to indicate that two or more components are in direct physical or electrical contact. However, the terms such as "coupled" or "communicatively coupled" may also mean that two or more components are not in direct contact with each other but still cooperate or interact with each other. The embodiments disclosed herein are not necessarily limited to the contents herein.

The use of the phrase "adapted to" or "configured to" is meant as an open and inclusive language that does not foreclose devices adapted to or configured to perform additional tasks or steps.

Figure 1A:
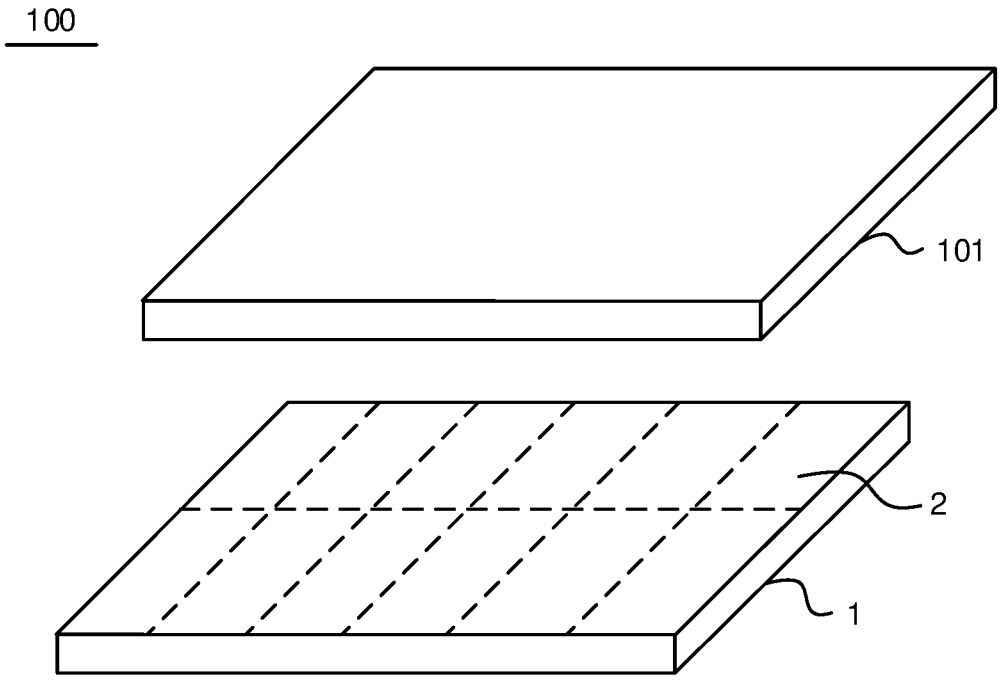
FIG. 1A is a diagram showing a structure of a display device, in accordance with some embodiments.

Some embodiments of the present disclosure provide a display device 100. As shown in FIG. 1A, the display device 100 includes a display panel 101 and a backlight module 1 disposed at a side of the display panel 101. The backlight module 1 has a plurality of backlight partitions 2.

Figure 1B:
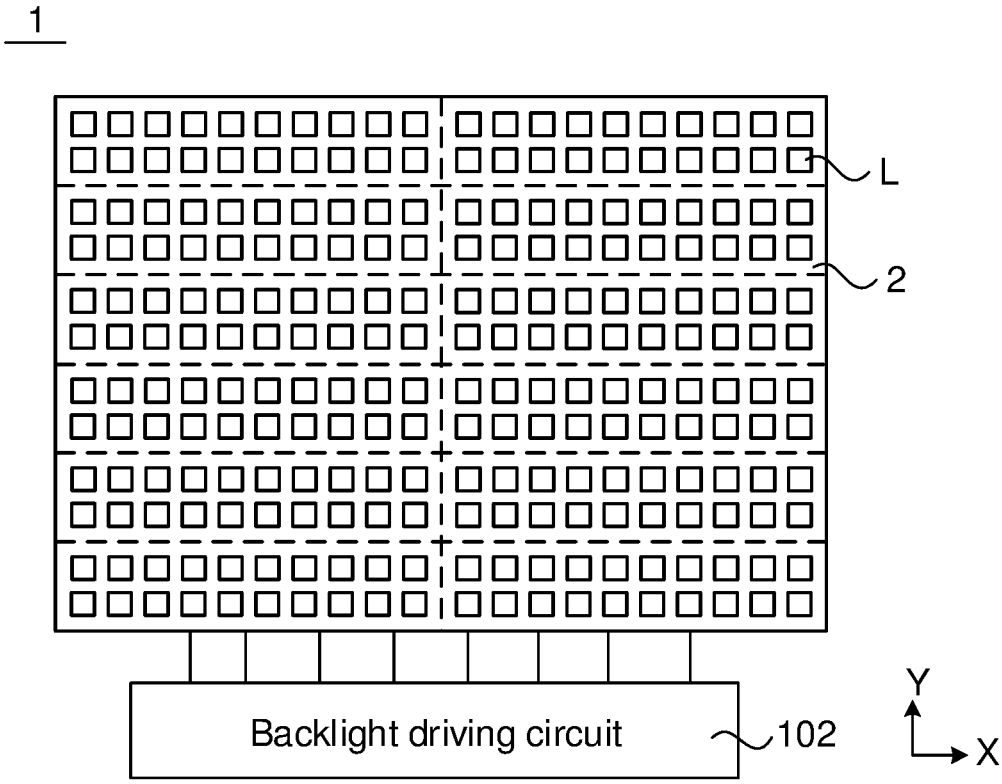
FIG. 1B is a diagram showing a structure of a backlight module, in accordance with some embodiments.

In some embodiments, as shown in FIG. 1B, the backlight module 1 includes a plurality of light-emitting devices L. Each backlight partition 2 is provided with some of the plurality of light-emitting devices L (i.e., a group).

Figure 10:
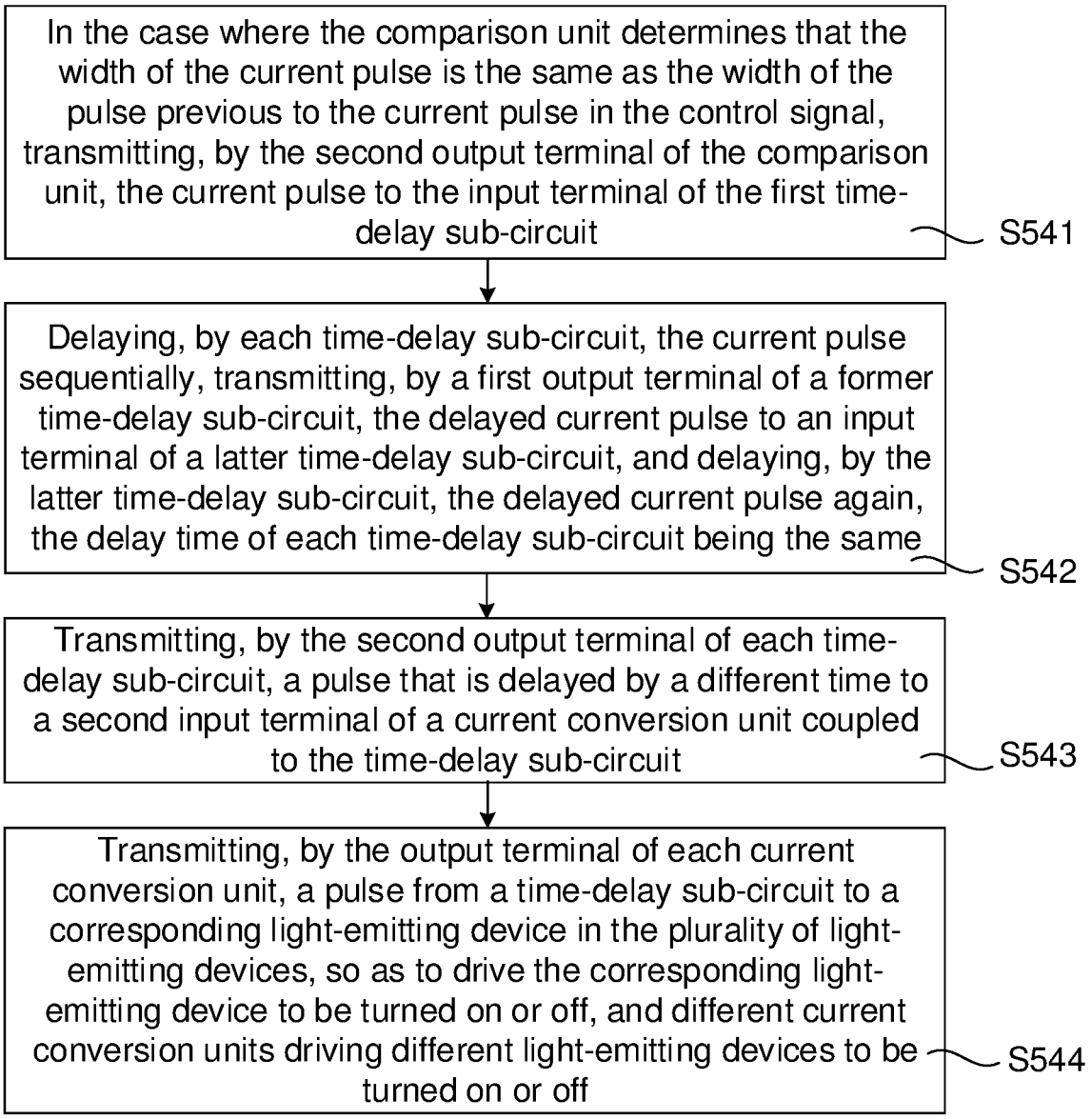
FIG. 10 is a flow diagram of yet another backlight driving method, in accordance with some embodiments.

For example, the backlight module 1 is a direct-type backlight module. As shown in FIG. 10, the backlight module 1 includes a backplane 110, a lamp panel 120 disposed on the backplane 110 and a light guide plate 140 disposed at a side of the lamp panel 120 facing away from the backplane 110. The lamp panel 120 includes a circuit board 121 and a plurality of light-emitting devices L disposed on a surface of the circuit board 121 facing the light guide plate 140.

For example, each light-emitting devices L may be a light-emitting diode (LED).

The backlight module 1 is controlled by a local dimming technique to emit light.

For example, as shown in FIG. 1 B, the backlight module 1 may be divided into a plurality of backlight partitions 2 in a row direction (i.e. a horizontal direction X) and a column direction (i.e. a vertical direction Y).

Here, the plurality of backlight partitions 2 may be arranged in an array in the X and Y directions, and light-emitting devices L spaced apart from each other in each backlight partitions 2 may be also arranged in an array in the X and Y directions. The embodiments of the present disclosure does not limit the number and arrangement of the backlight partitions 2 and the number and arrangement of the light emitting devices L in each backlight partition 2, which may be designed based on the display requirements of the display device 100 in which the backlight module 1 is applied.

In some embodiments, as shown in FIG. 1B, the backlight module 1 further includes a backlight driving circuit 102. The backlight driving circuit 102 is coupled to the plurality of light-emitting devices L to drive at least one of the light-emitting devices L to emit light.

For example, the backlight driving circuit 102 includes at least one inductance component and at least one switching component (e.g., a metal-oxide semiconductor field-effect transistor (MOSFET)). The switching component performs a high-frequency turn-on and turn-off operation to control the at least one light-emitting device L. In this case, the switching component operates under control of a pulse width modulation (PWM) signal. In a case where the PWM signal is a high level signal, the switching component switches between two operation modes, i.e. a turn-on mode and a turn-off mode, at a certain frequency. In this case, corresponding to the two operation modes, the inductance component in the backlight driving circuit 102 also switches between two operation modes, i.e. a charging mode and a discharging mode, at a certain frequency, and the inductance component is in a normal operation state in the two operation modes. In a case where the PWM signal is a low level signal, the switching component does not operate. In this case, the inductance component is in an abnormal operation state.

An operating frequency of the PWM signal is within a range from hundreds of hertz to thousands of hertz, which is within an audible range of human ears. Therefore, noise generated when the PWM signal operates is easy to be heard by the human ears. In addition, according to an energy-storage characteristic of the inductance component, in a case where the inductance component is in the abnormal operation state under control of the PWM signal, there is still current in the inductance component, and if a magnetic coil in the inductance component is not firmly fixed, a magnetic field generated by the current will make the magnetic coil subject to force and then vibrate, thereby generating noise. If the backlight driving circuit 102 includes a plurality of inductance components, and the plurality of inductance components are controlled by PWM signals with a same frequency and a same timing, the magnetic coils in the plurality of inductance components will resonate, which causes an enhancement of the noise, and causes that performances of the display device 100 are seriously affected in a case where the noise reaches a certain level.

In the related art, in order to reduce the noise, a material and a manufacturing process of the inductance component are improved. However, in order to ensure a display brightness, the inductance component in the backlight driving circuit 102 usually has a large inductance value and allows a large current to pass through. In this way, a difficulty of the manufacturing process of the inductance component is increased, and it is very difficult to manufacture a firm and non-vibrating inductance magnetic coil.

Figure 3:
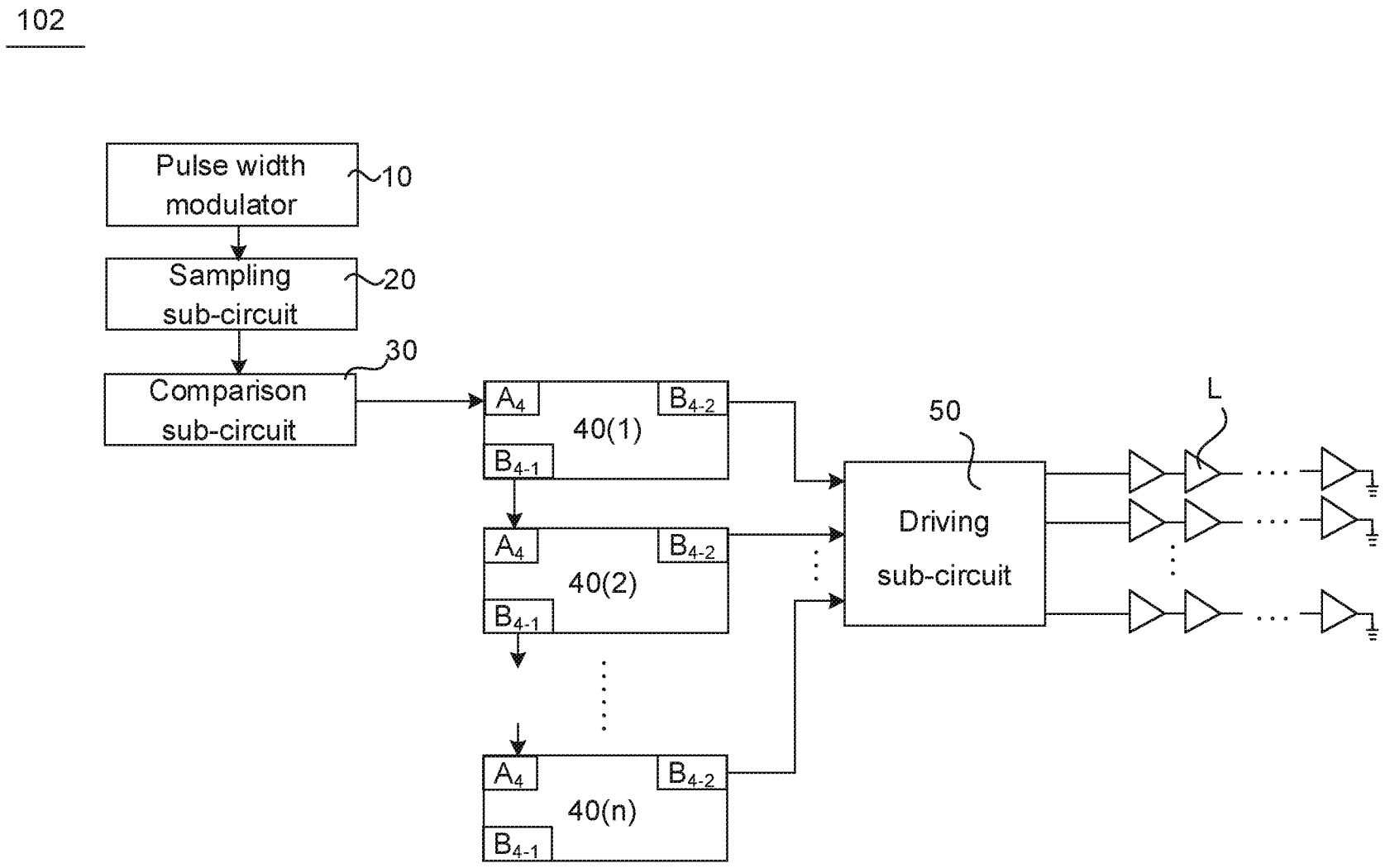
FIG. 3 is a diagram showing a structure of another backlight driving circuit, in accordance with some embodiments.

Some embodiments of the present disclosure provide a backlight driving circuit 102. As shown in FIG. 3, the backlight driving circuit 102 includes a pulse width modulator 10, at least one time-delay sub-circuit 40 and a driving sub-circuit 50.

The driving sub-circuit 50 is coupled to the at least one time-delay sub-circuit 40 and the plurality of light-emitting devices L in the backlight module 1.

The pulse width modulator 10 is configured to transmit a control signal including a plurality of pulses.

The at least one time-delay sub-circuit 40 is configured to delay at least one pulse of the control signal from the pulse width modulator 10 that is transmitted to the time-delay sub-circuit 40 by a set time.

The driving sub-circuit 50 is configured to drive at least one of the plurality of light-emitting devices L to be turned on or off according to a control signal from the at least one time-delay sub-circuit 40 obtained after the at least one pulse is delayed.

It will be noted that, relative to the at least one pulse of the control signal received by the at least one time-delay sub-circuit 40, at least one pulse of the control signal output by the at least one time-delay sub-circuit 40 to the driving sub-circuit 50 is delayed by a certain time. The delayed time is a preset time.

For example, the driving sub-circuit 50 includes at least one switching component and at least one inductance component. The pulse width modulator 10 can control turn-on and turn-off times of the at least one switching component in the driving sub-circuit 50 by changing a duty cycle of the pulses in the control signal, so as to control one or more light-emitting devices L.

In this case, at least one pulse of the control signal transmitted by the at least one time-delay sub-circuit 40 to the driving sub-circuit 50 is delayed by the certain time. Therefore, a timing of the control signal received by the driving sub-circuit 50 is different, and at least one light-emitting device L in the backlight module 1 can be controlled to be turned on or off. In this way, operating timings of components (e.g., the at least one inductance component and the at least one switching component) in the driving sub-circuit 50 are not completely the same, and operating frequencies of components (e.g., the at least one inductance component and the at least one switching component) in the driving sub-circuit 50 are not completely the same, which may prevent the magnetic coils in the driving sub-circuit 50 from resonating and then generating loud noise.

Therefore, the backlight driving circuit 102 provided by the embodiments of the present disclosure can delay at least one pulse of the control signal by the at least one time-delay sub-circuit 40, so as to generate a plurality of pulses with different timings to control the driving sub-circuit 50 to drive at least one light-emitting device L in the backlight module 1 to be turned on or off. In this case, the operating timings of the components (e.g., the at least one inductance component and the at least one switching component) in the driving sub-circuit 50 are not completely the same, and the operating frequencies of the components (e.g., the at least one inductance component and the at least one switching component) in the driving sub-circuit 50 are not completely the same, which may prevent the magnetic coils in the driving sub-circuit 50 from resonating and then generating loud noise, thereby improving the performances of the display device 100.

In some embodiments, as shown in FIG. 3, the backlight driving circuit 102 includes a plurality of time-delay sub-circuits 40 coupled in sequence. Each time-delay sub-circuit 40 includes an input terminal $A_4$, a first output terminal $B_{4-1}$ and a second output terminal $B_{4-2}$.

An input terminal $A_4$ of a first time-delay sub-circuit 40(1) is coupled to the pulse width modulator 10.

In any two adjacent time-delay sub-circuits 40, a first output terminal $B_{4-1}$ of a former time-delay sub-circuit 40 is coupled to an input terminal $A_4$ of a latter time-delay sub-circuit 40.

Here, the terms "former time-delay sub-circuit" and "latter time-delay sub-circuit" are taken the first time-delay sub-circuit 40(1) directly coupled to the pulse width modulator 10 as a reference. That is, along a coupling direction of the plurality of time-delay sub-circuits 40, in any two adjacent time-delay sub-circuits 40, a time-delay sub-circuit 40 close to the first time-delay sub-circuit 40 (1) is called the former time-delay sub-circuit 40, accordingly, a time-delay sub-circuit 40 away from the first time-delay subcircuit 40(1) is called the latter time-delay subcircuit 40.

The second output terminal $B_{4-2}$ of each time-delay sub-circuit 40 is coupled to the driving sub-circuit 50.

For example, in a case where the backlight driving circuit 102 includes n time-delay sub-circuits 40 coupled in sequence, and n is a positive integer greater than 1, a first output terminal $B_{4-1}$ of a j-th time-delay sub-circuit 40(*j*) is coupled to an input terminal $A_4$ of a (j+1)-th time-delay sub-circuit 40(*j*+1), and j is an integer value sequentially taken in set [1, n−1]. Here, in a case where j is equal to 1 (j=1), the input terminal $A_4$ of the first time-delay sub-circuit 40(1) is coupled to the pulse width modulator 10.

In this case, the input terminal $A_4$ of the first time-delay sub-circuit 40(1) receives the original control signal from the pulse width modulator 10, and the first time-delay sub-circuit 40(1) delays at least one pulse of the control signal by a set time $t_1$ for a first time.

A first output terminal $B_{4-1}$ of the first time-delay sub-circuit 40(1) transmits the control signal having the delayed at least one pulse to an input terminal $A_4$ of a second time-delay sub-circuit 40(2). The second time-delay sub-circuit 40(2) delays the at least one pulse of the control signal output by the first time-delay sub-circuit 40(1), which is delayed by the time $t_1$, by a set time $t_2$ for a second time. Then, relative to the at least one pulse of the control signal from the pulse width modulator 10, at least one pulse of a control signal output from a first output terminal $B_{4-1}$ of the second time-delay sub-circuit 40(2) is delayed by a time $(t_1+t_2)$.

By analogy, an n-th time-delay sub-circuit 40(*n*) delays at least one pulse of a control signal output from a first output terminal $B_{4-1}$ of a (n−1)-th time-delay sub-circuit 40(n−1), which is delayed by a time $(t_1+t_2+\ldots+t_{n-1})$, by a set time to for an n-th time. Then, relative to the at least one pulse of the control signal from the pulse width modulator 10, at least one pulse of a control signal output from a first output terminal $B_{4-1}$ of the n-th time-delay sub-circuit 40(*n*) is delayed by a time $(t_1+t_2+\ldots+t_{n-1}+t_n)$.

It will be understood that, a first output terminal $B_{4-1}$ of a former time-delay sub-circuit 40 is coupled to an input terminal $A_4$ of a latter time-delay sub-circuit 40. That is, the plurality of time-delay sub-circuits 40 are sequentially coupled in series. Therefore, a time by which each time-delay sub-circuit 40 delays at least one pulse of a control signal is extended in a cumulative manner. In this case, since the driving sub-circuit 50 is coupled to the plurality of time-delay sub-circuits 40, and the driving sub-circuit 50 drives different light-emitting devices L in the driving backlight module to be turned on or off according to pulses that are delayed by different times output from the second output terminals $B_{4-2}$ of the plurality of time-delay sub-circuits 40.

In some embodiments, as shown in FIG. 3, the backlight driving circuit 102 further includes a sampling sub-circuit 20 and a comparison sub-circuit 30.

The input terminal $A_4$ of the first time-delay sub-circuit 40(1) is coupled to the pulse width modulator 10 by the sampling sub-circuit 20 and the comparison sub-circuit 30.

The sampling sub-circuit 20 is coupled to the pulse width modulator 10. The comparison sub-circuit 30 is coupled to the sampling sub-circuit 20 and the input terminal $A_4$ of the first time-delay sub-circuit 40(1).

The sampling sub-circuit 20 is configured to collect the control signal from the pulse width modulator 10.

The comparison sub-circuit 30 is configured to receive the control signal collected by the sampling sub-circuit 20, to determine whether widths of any two adjacent pulses in the control signal are the same, and to transmit a latter pulse in the two adjacent pulses to the input terminal $A_4$ of the first time-delay sub-circuit40(1) in a case where it is determined that the widths of the two adjacent pulses are the same.

Here, the term "latter pulse" is taken an order in which the plurality of pulses in the control signal are output from the pulse width modulator 10 as a reference. That is, in any two adjacent pulses, a pulse output by the pulse width modulator 10 first is called a former pulse, accordingly, a pulse output by the pulse width modulator 10 after is called the latter pulse.

Through collecting the control signal from the pulse width modulator 10 by the sampling sub-circuit 20, parameters, such as a frequency and the duty cycle, of the pulses of the control signal can be obtained.

It will be noted that, determining whether widths of any two adjacent pulses in the control signal are the same is, in fact, determining whether there are changes in the frequency and the duty cycle of the control signal. Thus, whether the control signal adjusts and changes brightness of the light-emitting devices L in the backlight module 1 may be determined according to the changes in the frequency and the duty cycle of the control signal.

It will be noted that, no signal is output from a first output terminal $B_{4-1}$ of a last time-delay sub-circuit 40.

That is to say, in some example, the last time-delay sub-circuit 40 may have no first output terminal $B_{4-1}$. Except for the last time-delay sub-circuit 40, signals output from the second output terminal $B_{4-2}$ and the first output terminal $B_{4-1}$ of each of remaining time-delay sub-circuits 40 are the same. In this case, the second output terminal $B_{4-2}$ and the first output terminal $B_{4-1}$ of the time-delay sub-circuit 40 may be a same signal terminal.

Figure 4:
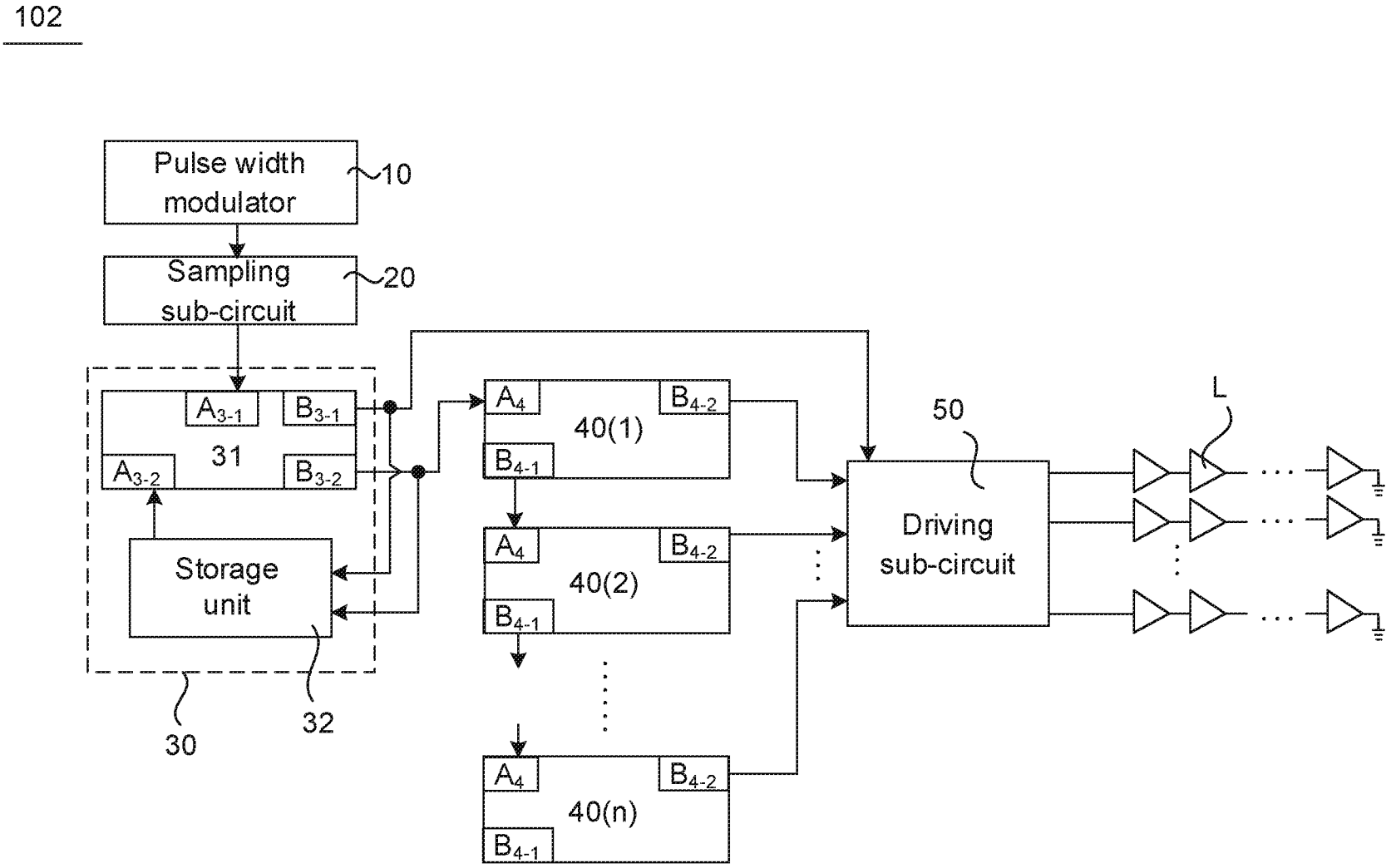
FIG. 4 is a diagram showing a structure of yet another backlight driving circuit, in accordance with some embodiments.

In some embodiments, as shown in FIG. 4, the comparison sub-circuit 30 is further coupled to the driving sub-circuit 50.

The comparison sub-circuit 30 includes a comparison unit 31 and a storage unit 32.

The comparison unit 31 includes a first input terminal $A_{3-1}$, a second input terminal $A_{3-2}$, a first output terminal $B_{3-1}$, and a second output terminal $B_{3-2}$. The first input terminal $A_{3-1}$ of the comparison unit 31 is coupled to the sampling sub-circuit 20, the second input terminal $A_{3-2}$ of the comparison unit 31 is coupled to the storage unit 32, the first output terminal $B_{3-1}$ of the comparison unit 31 is coupled to the driving sub-circuit 50 and the storage unit 32, and the second output terminal $B_{3-2}$ of the comparison unit 31 is coupled to the first time-delay sub-circuit 40(1) and the storage unit 32.

The comparison unit 31 is configured to: by the first input terminal $A_{3-1}$ of the comparison unit 31, receive the control signal collected by the sampling sub-circuit 20, by the second input terminal $A_{3-2}$ of the comparison unit 31, receive a pulse previous to a current pulse in the control signal that has been stored in the storage unit 32, and determine whether a width of the current pulse is the same as a width of the pulse previous to the current pulse in the control signal. If not, the current pulse is output by the first output terminal $B_{3-1}$ of the comparison unit 31, and if so, the current pulse is output by the second output terminal $B_{3-2}$ of the comparison unit 31.

The storage unit 32 is configured to sequentially store pulses of a control signal output from the first output terminal $B_{3-1}$ or the second output terminal $B_{3-2}$ of the comparison unit 31, and to make a latter pulse to be stored replace a former pulse that has been stored.

For example, in a case where the control signal collected by the sampling sub-circuit 20 that is received by the first input terminal $A_{3-1}$ of the comparison unit 31 includes m pulses, and m is a positive integer greater than 1, the second input terminal $A_{3-2}$ of the comparison unit 31 receives an i-th pulse in the control signal that has been stored in the storage unit 32, and determines whether a width of a (i+1)-th pulse is the same as a width of the i-th pulse in the control signal. If not, the first output terminal $B_{3-1}$ of the comparison unit 31 outputs the (i+1)-th pulse, if so, the second output terminal B3-2 of the comparison unit 31 outputs the (i+1)th pulse, and i is an integer value sequentially taken in set [1, m−1].

In this case, the storage unit 32 sequentially stores the pulses of the control signal output from the first output terminal $B_{3-1}$ or the second output terminal $B_{3-2}$ of the comparison unit 31, and makes the (i+1)-th pulse replace the i-th pulse. That is, the storage unit 32 deletes the i-th pulse that has been stored while storing the (i+1)-th pulse.

It will be understood that, a first pulse in the control signal collected by the sampling sub-circuit 20 that is received by the first input terminal $A_{3-1}$ of the comparison unit 31 is directly stored in the storage unit 32 via the comparison unit 31.

In a case where the width of the current pulse is different from the width of the pulse previous to the current pulse, that is, in a case where the frequency or the duty cycle of the control signal is changed, the control signal adjusts brightness of each backlight partition 2 in the backlight module 1, and any pulse of the control signal is not delayed. In this case, the first output terminal $B_{3-1}$ of the comparison unit 32 directly transmits the control signal to the driving sub-circuit 50, and the delayed time of the control signal is zero (that is, any pulse of the control signal is not delayed), which may prevent a uniformity of the brightness of each backlight partition 2 from being affected.

In a case where the width of the current pulse is the same as the width of the pulse previous to the current pulse, that is, in a case where the frequency or the duty cycle of the control signal is not changed, the control signal does not adjust the brightness of each backlight partition 2 in the backlight module 1, and at least one pulse of the control signal may be delayed. In this case, the second output terminal $B_{3-2}$ of the comparison unit 32 transmits the control signal to the input terminal $A_4$ of the first time-delay sub-circuit 40(1), so that each time-delay sub-circuit 40 sequentially delays the at least one pulse of the control signal, a first output terminal $B_{4-1}$ of a former time-delay sub-circuit 40 transmits a delayed current pulse to an input terminal $A_4$ of a latter time-delay sub-circuit 40, and the latter time-delay sub-circuit 40 delays the delayed current pulse again, and the second output terminal $B_{4-2}$ of each time-delay sub-circuit 40 transmits a delayed pulse to the driving sub-circuit 50.

Figure 5A:
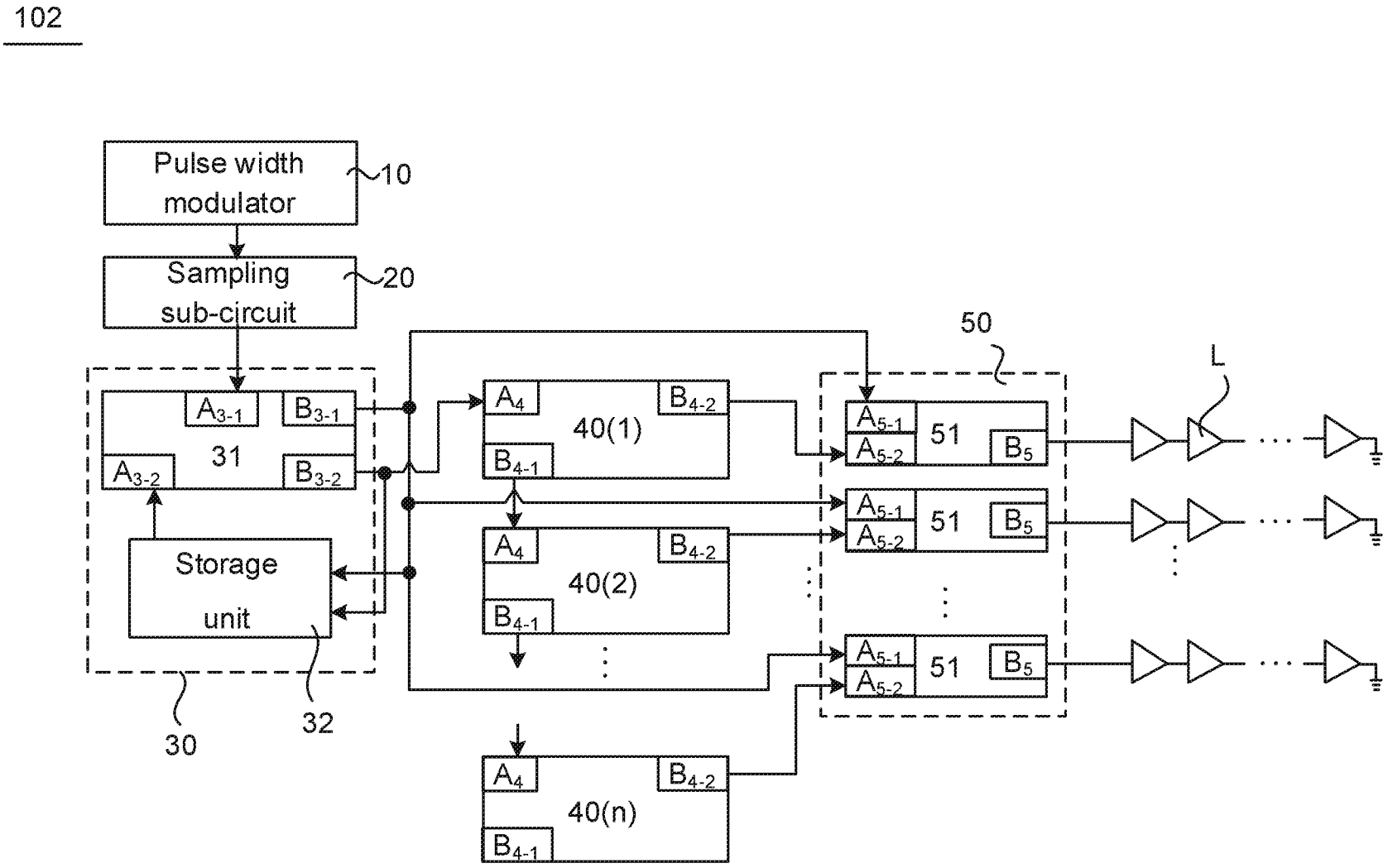
FIG. 5A is a diagram showing a structure of yet another backlight driving circuit, in accordance with some embodiments.
Figure 5B:
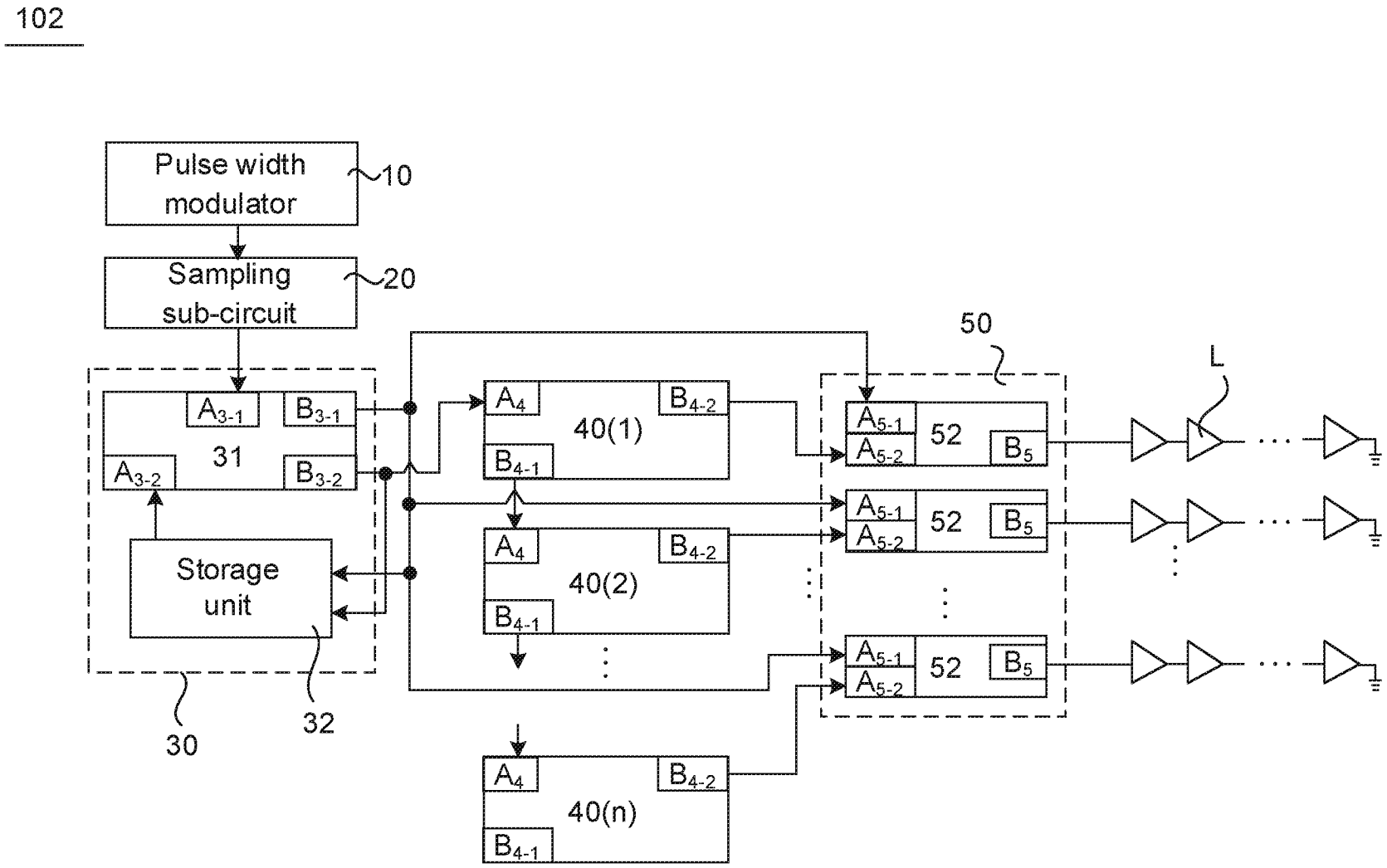
FIG. 5B is a diagram showing a structure of yet another backlight driving circuit, in accordance with some embodiments.
Figure 5C:
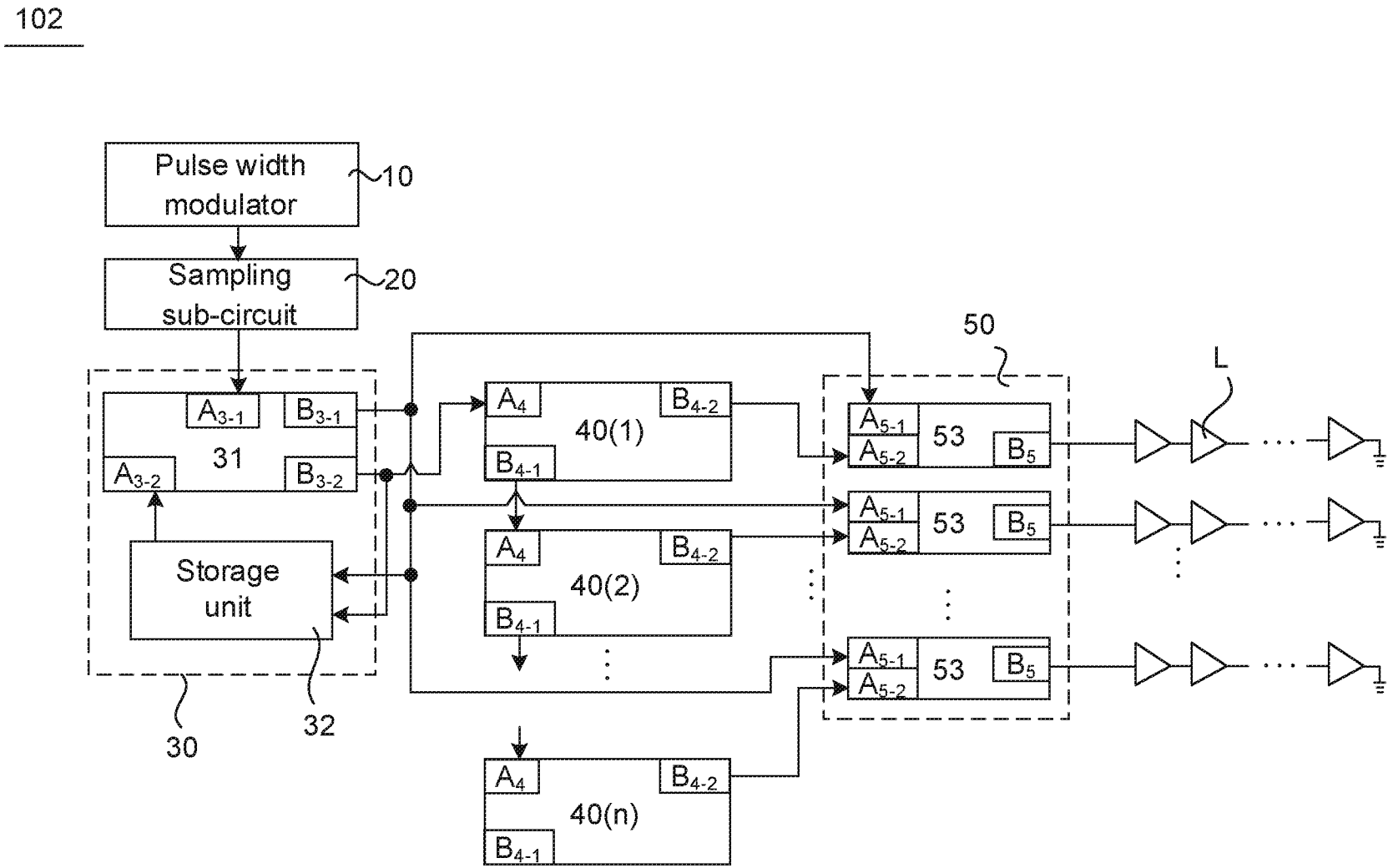
FIG. 5C is a diagram showing a structure of yet another backlight driving circuit, in accordance with some embodiments.
Figure 5D:
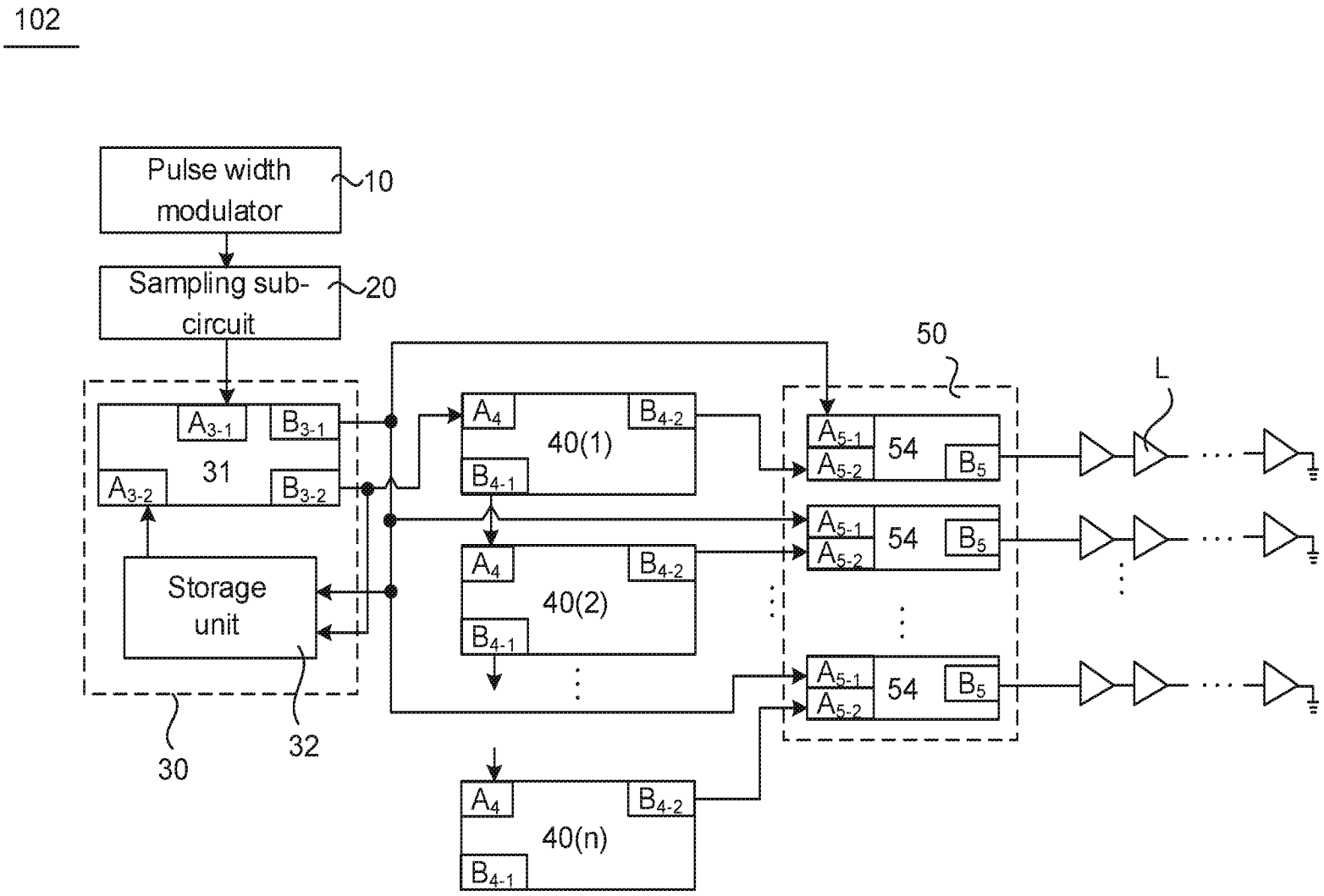
FIG. 5D is a diagram showing a structure of yet another backlight driving circuit, in accordance with some embodiments.
Figure 5E:
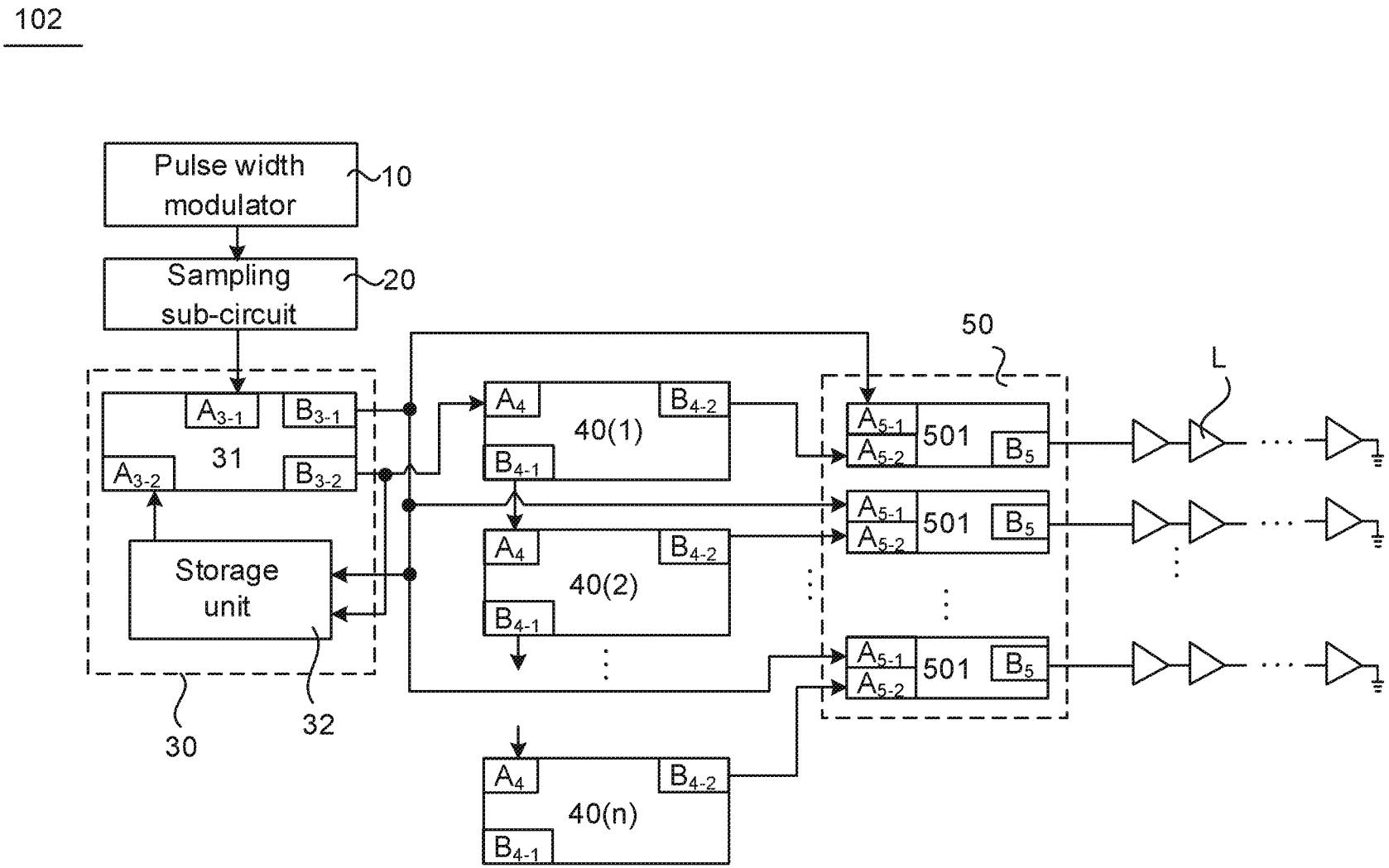
FIG. 5E is a diagram showing a structure of yet another backlight driving circuit, in accordance with some embodiments.

In some embodiments, as shown in FIG. 5E, the driving sub-circuit 50 includes a plurality of current conversion units 501, and a current conversion unit 501 is coupled to a time-delay sub-circuit 40.

Each current conversion unit 501 includes a first input terminal $A_{5-1}$, a second input terminal $A_{5-2}$, and an output terminal $B_5$. The first input terminal $A_{5-1}$ of the current conversion unit 501 is coupled to the first output terminal $B_{3-1}$ of the comparison unit 31, the second input terminal $A_{5-2}$ of the current conversion unit 501 is coupled to a second output terminal $B_{4-2}$ of a corresponding time-delay sub-circuit 40, and the output terminal $B_5$ of the current conversion unit 501 is coupled to at least one of the plurality of light-emitting devices L.

The output terminals $B_5$ of different current conversion units 501 are coupled to different light-emitting devices L.

For example, different backlight partitions 2 are controlled by different current conversion units 501, and a current conversion unit 501 controls a backlight partition 2. That is, a current conversion unit 501 controls at least one of the light-emitting devices L in a backlight partition 2 to be turned on or off. For example, as shown in FIG. 1B, in a case where the backlight module 1 is divided into twelve identical backlight partitions 2, and each backlight partition 2 is provided with twenty light-emitting devices L (i.e., a group), the twelve backlight partitions 2 are controlled by twelve current conversion units 501

On this basis, in the case where the comparison unit 32 determines that the width of the current pulse is different from the width of the pulse previous to the current pulse in the control signal, any pulse of the control signal is not delayed. The first output terminal $B_{3-1}$ of the comparison unit 32 directly transmits the control signal to the first input terminals $A_{5-1}$ of the plurality of current conversion units 501 in the driving sub-circuit 50, so that the current conversion units 501 control light-emitting devices L that are correspondingly coupled to the current conversion units 501 to emit light. Therefore, any pulse of the control signal transmitted to each current conversion unit 501 is not delayed, so that a timing of the control signal transmitted to each current conversion unit 501 is the same, thereby ensuring the uniformity of the brightness of each backlight partition 2.

Figure 2:
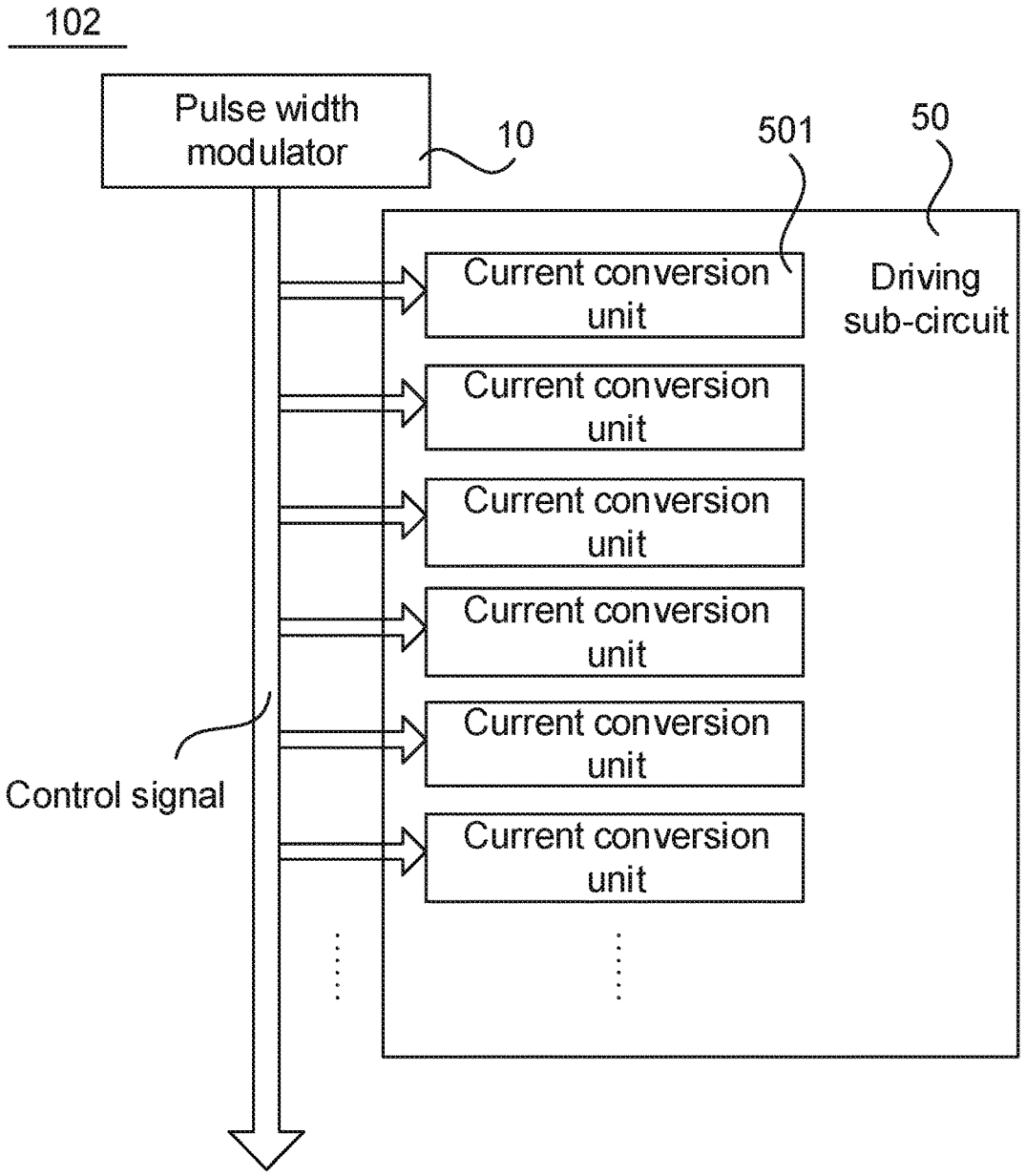
FIG. 2 is a diagram showing a structure of a backlight driving circuit, in accordance with some embodiments.

That is, as shown in FIG. 2, the control signal transmitted by the pulse width modulator 10 may control the plurality of current conversion units 501, and the plurality of current conversion units 501 synchronously adjust the light-emitting devices L that are correspondingly coupled to the plurality of current conversion units 501, thereby ensuring a consistency of brightness adjustments and avoiding a phenomenon of non-uniform brightness of the backlight module 1.

In the case where the comparison unit 32 determines that the width of the current pulse is the same as the width of the pulse previous to the current pulse in the control signal, at least one pulse of the control signal is to be delayed. The second output terminal $B_{3-2}$ of the comparison unit 32 transmits the control signal to the input terminal $A_4$ of the first time-delay sub-circuit 40(1), the first time-delay sub-circuit 40(1) delays at least one pulse of the control signal, and the second output terminal $B_{4-2}$ of the first time-delay sub-circuit 40(1) transmits a control signal obtained after the at least one pulse is delayed to a second input terminal $A_{5-2}$ of a current conversion unit 501 that is correspondingly coupled to the first time-delay sub-circuit 40(1), and to an input terminal $A_4$ of a latter time-delay sub-circuit 40.

By analogy, each time-delay sub-circuit 40 sequentially delays at least one pulse of the control signal. A first output terminal $B_{4-1}$ of a former time-delay sub-circuit 40 transmits a delayed current pulse to an input terminal $A_4$ of a latter time-delay sub-circuit 40, and the latter time-delay sub-circuit 40 delays the delayed current pulse again. The second output terminal $B_{4-2}$ of each time-delay sub-circuit 40 transmits a delayed pulse to a second input terminal $A_{5-2}$ of a DC-DC conversion circuit 51. Therefore, pulses of the control signal received by different current conversion units 501 are delayed by different times, so that the signal adjustment timings of the current conversion units 501 are different, and it is possible to avoid a problem that the noise is intensified due to a fact that noise (which is, for example, generated due to resonance of inductance coils in the current conversion units 501) generated when the current conversion units 501 operate has a same frequency and a same timing, thereby improving an operating effect of the backlight driving circuit.

In some embodiments, as shown in FIG. 5A, the current conversion unit 501 includes a direct current-direct current (DC-DC) conversion circuit 51.

As shown in FIG. 5A, a DC-DC conversion circuit 51 is coupled to a time-delay sub-circuit 40. A first input terminal $A_{5-1}$ of the DC-DC conversion circuit 51 is coupled to the first output terminal $B_{3-1}$ of the comparison unit 31, a second input terminal $A_{5-2}$ of the DC-DC conversion circuit 51 is coupled to a second output terminal $B_{4-2}$ of a corresponding time-delay sub-circuit 40, and an output terminal $B_5$ of the DC-DC conversion circuit 51 is coupled to at least one of the plurality of light-emitting devices L. The output terminals $B_5$ of different DC-DC conversion units 51 are coupled to different light-emitting devices L.

In some embodiments, in a case where the current conversion unit 501 includes the DC-DC conversion circuit 51, delay times of all the time-delay sub-circuits 40 are the same, and a sum of the delay times of all the time-delay sub-circuits 40 is less than or equal to a reciprocal of an operating frequency of the DC-DC conversion circuit 51.

For example, in a case where the delay time of each time-delay sub-circuit 40 is t, after the control signal is delayed by the first time-delay sub-circuit 40(1), the second output terminal $B_{4-2}$ of the first time-delay sub-circuit 40(1) outputs a control signal that is delayed by the time t and transmits it to a second input terminal $A_{5-2}$ of a DC-DC conversion circuit 51 coupled to the first time-delay sub-circuit 40(1), so as to control the DC-DC conversion circuit 51 coupled to the first time-delay sub-circuit 40(1).

After the control signal is delayed by the first time-delay sub-circuit 40(1) and the second time-delay sub-circuit 40(2), a second output terminal $B_{4-2}$ of the second time-delay sub-circuit 40(2) outputs a control signal that is delayed by a time 2t, so as to control a DC-DC conversion circuit 51 coupled to the second time-delay sub-circuit 40(2).

By analogy, in the case where the backlight driving circuit 102 includes n time-delay sub-circuits 40, after the control signal is delayed by the first time-delay sub-circuit 40(1) to the n-th time-delay sub-circuit 40(*n*), a second output terminal $B_{4-2}$ of the n-th time-delay sub-circuits 40(*n*) outputs a control signal that is delayed by a time (n×t), so as to control a DC-DC conversion circuit 51 coupled to the n-th time-delay sub-circuit 40(*n*).

In addition, the time (n×t) is less than or equal to the reciprocal of the operating frequency of the DC-DC conversion circuit 51. That is, a maximum delay time is less than or equal to a duration of an operating cycle of the DC-DC conversion circuit 51, so as to avoid affecting that the DC-DC conversion circuit 51 controls a normal operation of the backlight module 1.

In some other embodiments, as shown in FIG. 5B, the driving sub-circuit 50 includes a plurality of alternating current-direct current (AC-DC) conversion circuits 52.

As shown in FIG. 5B, a AC-DC conversion circuit 52 is coupled to a time-delay sub-circuit 40. A first input terminal $A_{5-1}$ of the AC-DC conversion circuit 52 is coupled to the first output terminal $B_{3-1}$ of the comparison unit 31, a second input terminal $A_{5-2}$ of the AC-DC conversion circuit 52 is coupled to a second output terminal $B_{4-2}$ of a corresponding time-delay sub-circuit 40, and an output terminal $B_5$ of the AC-DC conversion circuit 52 is coupled to at least one of the plurality of light-emitting devices L. The output terminals $B_5$ of the AC-DC conversion circuits 52 are coupled to different light-emitting devices L.

In some other embodiments, as shown in FIG. 5C, the driving sub-circuit 50 includes a plurality of direct current-alternating current (DC-AC) conversion circuits 53.

As shown in FIG. 5C, a DC-AC conversion circuit 53 is coupled to a time-delay sub-circuit 40. A first input terminal $A_{5-1}$ of the DC-AC conversion circuit 53 is coupled to the first output terminal $B_{3-1}$ of the comparison unit 31, a second input terminal $A_{5-2}$ of the DC-AC conversion circuit 53 is coupled to a second output terminal $B_{4-2}$ of a corresponding time-delay sub-circuit 40, and an output terminal $B_5$ of the DC-AC conversion circuit 53 is coupled to at least one of the plurality of light-emitting devices L. The output terminals $B_5$ of the DC-AC conversion circuits 53 are coupled to different light-emitting devices L.

In some other embodiments, as shown in FIG. 5D, the driving sub-circuit 50 includes a plurality of alternating current-alternating current (AC-AC) conversion circuits 54.

As shown in FIG. 5D, a AC-AC conversion circuit 54 is coupled to a time-delay sub-circuit 40. A first input terminal $A_{5-1}$ of the AC-AC conversion circuit 54 is coupled to the first output terminal $B_{3-1}$ of the comparison unit 31, a second input terminal $A_{5-2}$ of the AC-AC conversion circuit 54 is coupled to a second output terminal $B_{4-2}$ of a corresponding time-delay sub-circuit 40, and an output terminal $B_5$ of the AC-AC conversion circuit 54 is coupled to at least one of the plurality of light-emitting devices L. The output terminals $B_5$ of the AC-AC conversion circuits 54 are coupled to different light-emitting devices L.

It will be noted that, in the backlight driving circuit 102 provided by these embodiments of the present disclosure, each time-delay sub-circuit 40, the driving sub-circuit 50, the sampling sub-circuit 20, the comparison sub-circuit 30, the comparison unit 31, the storage unit 32 and each current conversion unit 501 may be any circuit or module capable of achieving corresponding function(s) in the field, which may be selected by a person of ordinary skill according to situations in practice, and is not limited in the present disclosure.

Figure 1C:
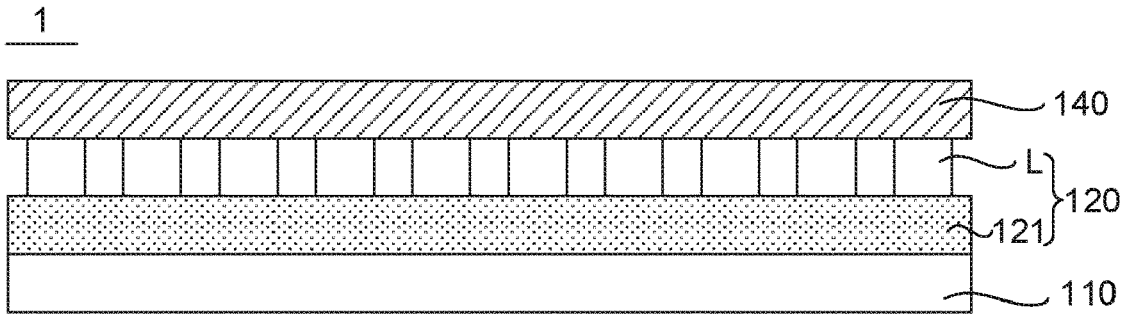
FIG. 1C is a diagram showing a structure of another backlight module, in accordance with some embodiments.

Some embodiments of the present disclosure provide a display device 100 including the display panel 101 shown in FIG. 1A and the backlight module 1 shown in FIGS. 1A, 1B and 1C.

As shown in FIG. 1B, the backlight module 1 includes the backlight driving circuit 102 according to the above embodiments and a plurality of light-emitting devices L. The plurality of light-emitting devices L are coupled to the backlight driving circuit 102.

It will be noted that, the display device 100 and the backlight module 1 both have same beneficial effects as the backlight driving circuit 102, which will not be repeated here.

Figure 6:
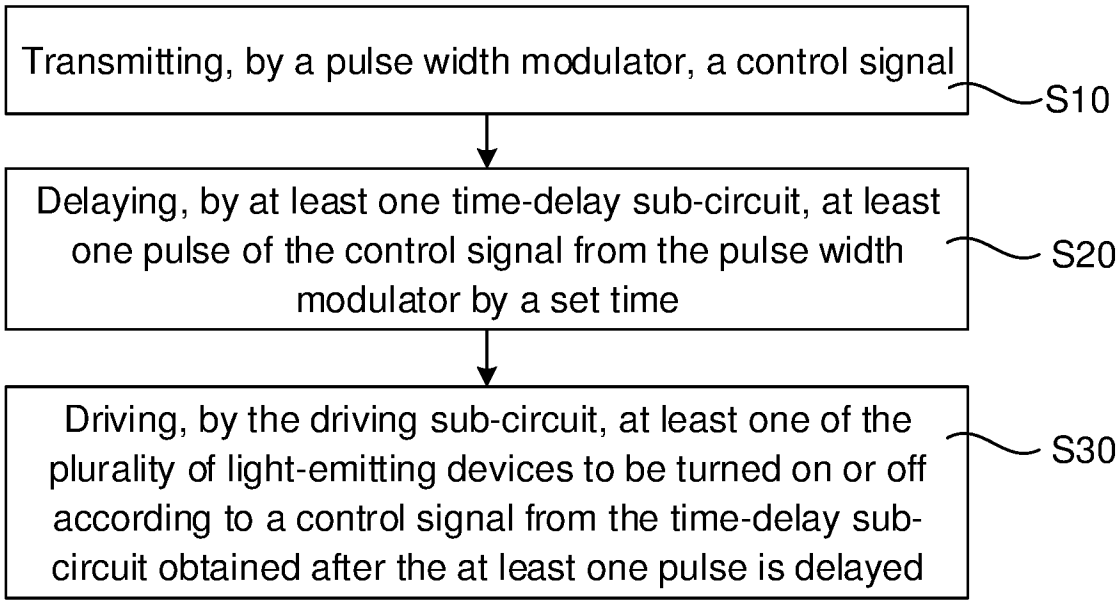
FIG. 6 is a flow diagram of a backlight driving method, in accordance with some embodiments.

Some embodiments of the present disclosure provide a backlight driving method applied to the backlight driving circuit 102 according to the above embodiments. As shown in FIG. 6, the method includes:

in S10, transmitting, by a pulse width modulator 10, a control signal;

in S20, delaying, by at least one time-delay sub-circuit 40, at least one pulse of the control signal from the pulse width modulator 10 by a set time; and in S30, driving, by the driving sub-circuit 50, at least one of the plurality of light-emitting devices L to be turned on or off according to a control signal from the time-delay sub-circuit 40 obtained after the at least one pulse is delayed.

In the backlight driving method provided by these embodiments of the present disclosure, the at least one pulse of the control signal can be delayed by the at least one time-delay sub-circuit 40 to generate a plurality of pulses with different timings to control the driving sub-circuit 50 to drive at least one of the light-emitting devices L in the backlight module 1 to be turned on or off. In this case, the operating timings of the components (e.g., the at least one inductance component and the at least one switching component) in the driving sub-circuit 50 are not completely the same, and the operating frequencies of the components (e.g., the at least one inductance component and the at least one switching component) in the driving sub-circuit 50 are not completely the same, which may prevent the magnetic coils in the driving sub-circuit 50 from resonating and then generating loud noise, thereby improving the performances of the display device.

Figure 7:
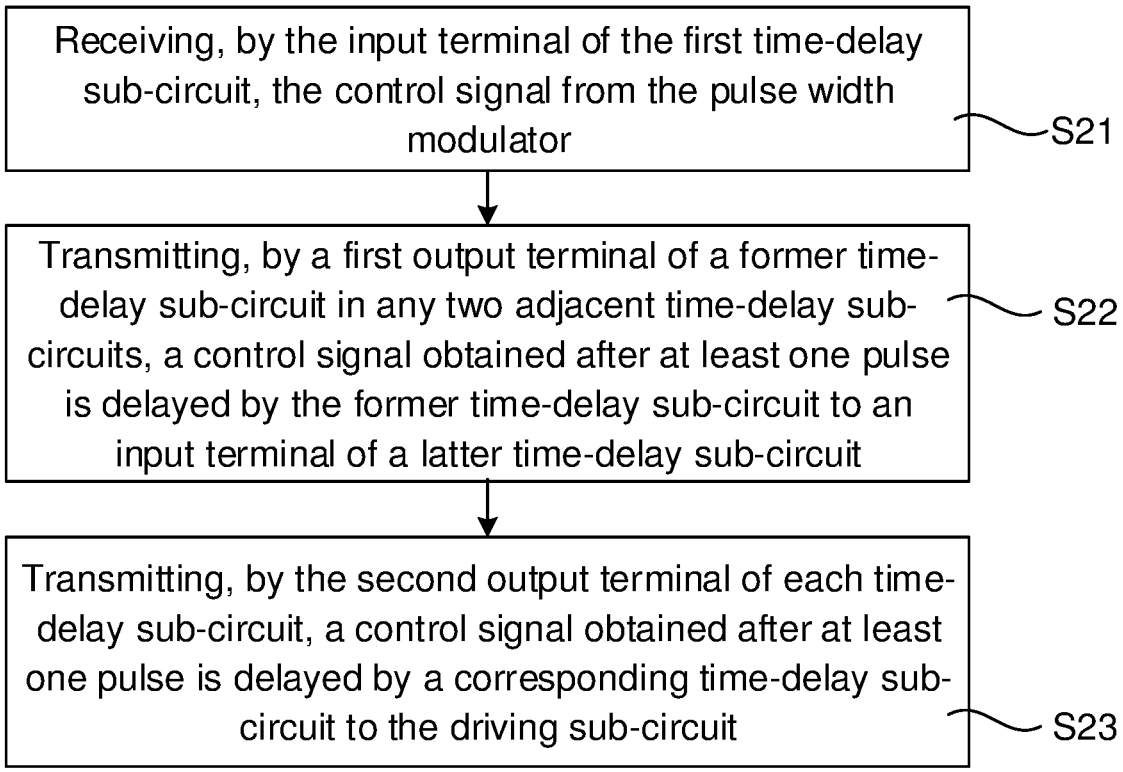
FIG. 7 is a flow diagram of another backlight driving method, in accordance with some embodiments.

In some embodiments, referring to FIG. 3, in a case where the backlight driving circuit 102 includes a plurality of time-delay sub-circuits 40 coupled in sequence, except for a last time-delay sub-circuit 40, each time-delay sub-circuit 40 includes an input terminal $A_4$, a first output terminal $B_{4-1}$ and a second output terminal $B_{4-2}$, and the last time-delay sub-circuit 40 includes an input terminal $A_4$ and a second output terminal $B_{4-2}$, as shown in FIG. 7, S20 includes:

in S21, receiving, by the input terminal $A_4$ of the first time-delay sub-circuit 40(1), the control signal from the pulse width modulator 10;

in S22, transmitting, by a first output terminal $B_{4-1}$ of a former time-delay sub-circuit 40 in any two adjacent time-delay sub-circuits 40, a control signal obtained after at least one pulse is delayed by the former time-delay sub-circuit 40 to an input terminal $A_4$ of a latter time-delay sub-circuit 40; and in S23, transmitting, by the second output terminal $B_{4-2}$ of each time-delay sub-circuit 40, a control signal obtained after at least one pulse is delayed by a corresponding time-delay sub-circuit 40 to the driving sub-circuit 50.

Figure 8:
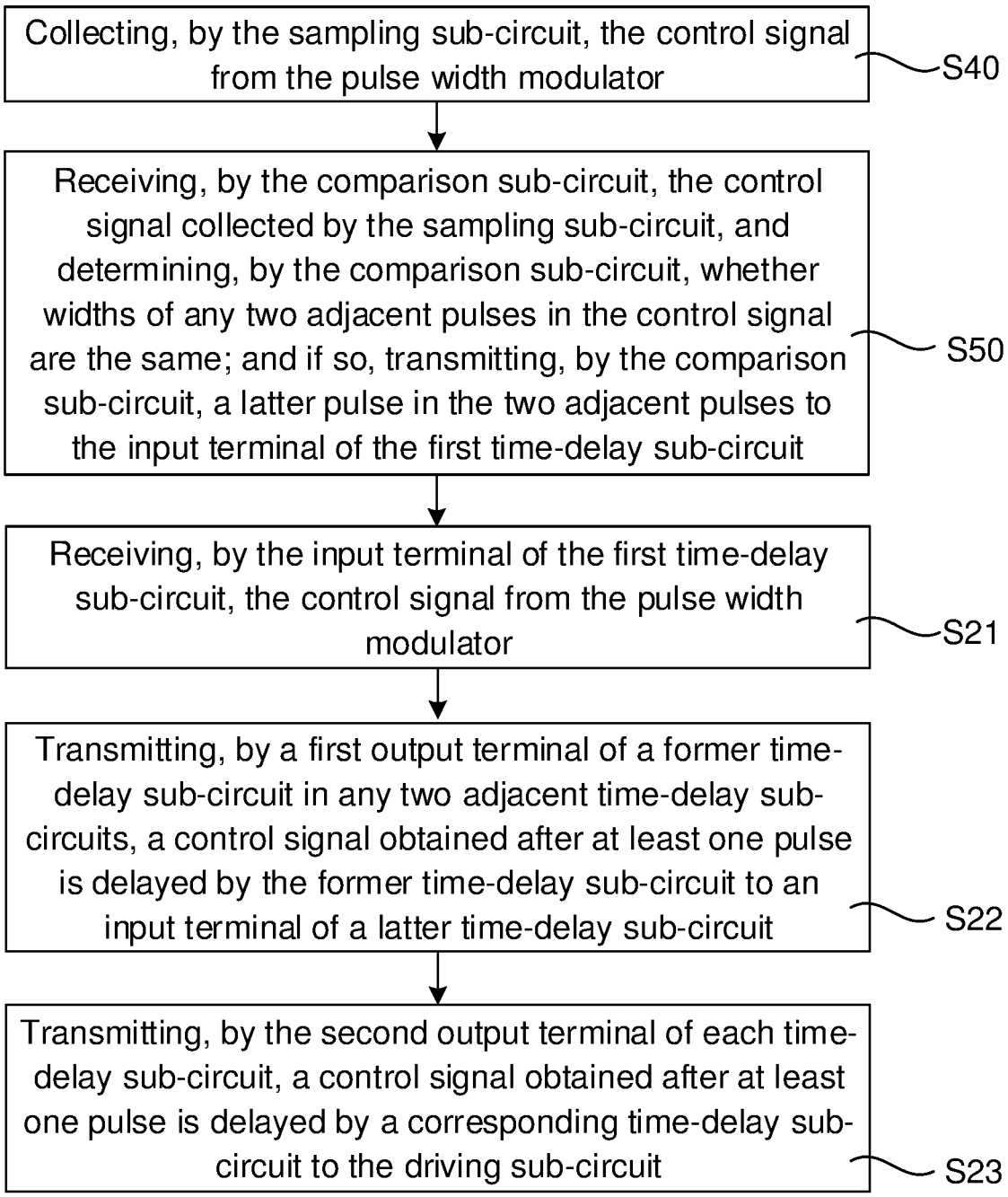
FIG. 8 is a flow diagram of yet another backlight driving method, in accordance with some embodiments.

In some embodiments, referring to FIG. 3, in a case where the backlight driving circuit 102 further includes a sampling sub-circuit 20 and a comparison sub-circuit 30, as shown in FIG. 8, the method further includes:

in S40, collecting, by the sampling sub-circuit 20, the control signal from the pulse width modulator 10; and in S50, receiving, by the comparison sub-circuit 30, the control signal collected by the sampling sub-circuit 20, and determining, by the comparison sub-circuit 30, whether widths of any two adjacent pulses in the control signal are the same; and if so, transmitting, by the comparison sub-circuit 30, a latter pulse in the two adjacent pulses to the input terminal $A_4$ of the first time-delay sub-circuit 40(1).

Figure 9:
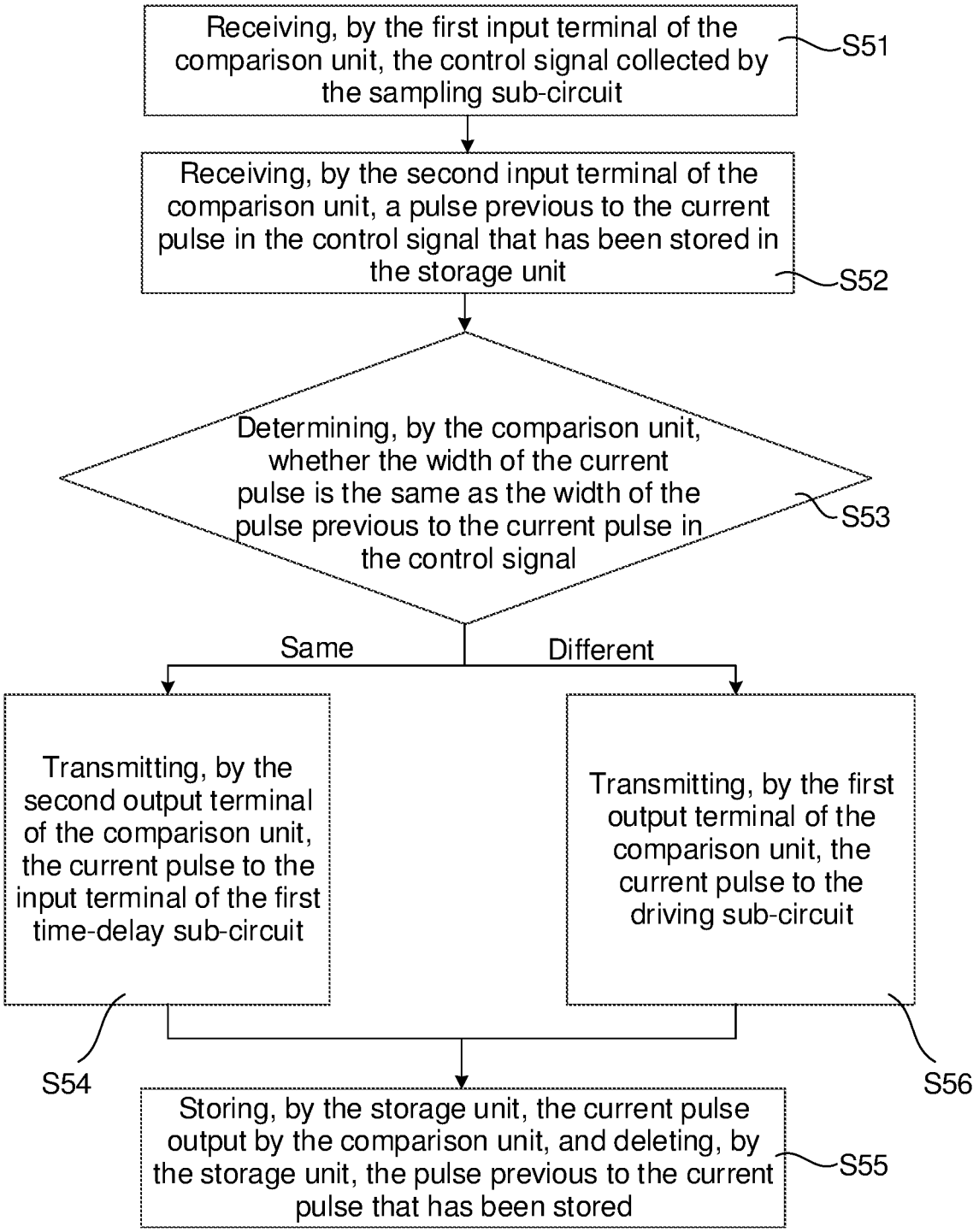
FIG. 9 is a flow diagram of yet another backlight driving method, in accordance with some embodiments.

In some embodiments, referring to FIG. 4, in a case where the comparison sub-circuit 30 includes a comparison unit 31 and a storage unit 32, and the comparison unit 31 includes a first input terminal $A_{3-1}$, a second input terminal $A_{3-2}$, a first output terminal $B_{3-1}$ and a second output terminal $B_{3-2}$, as shown in FIG. 9, S50 includes:

in S51, receiving, by the first input terminal $A_{3-1}$ of the comparison unit 31, the control signal collected by the sampling sub-circuit 20;

in S52, receiving, by the second input terminal $A_{3-2}$ of the comparison unit 31, a pulse previous to the current pulse in the control signal that has been stored in the storage unit 32;

in S53, determining, by the comparison unit 31, whether the width of the current pulse is the same as the width of the pulse previous to the current pulse in the control signal;

in S54, if so, transmitting, by the second output terminal $B_{3-2}$ of the comparison unit 31, the current pulse to the input terminal $A_4$ of the first time-delay sub-circuit 40(1); and in S55, storing, by the storage unit 32, the current pulse output by the comparison unit 31, and deleting, by the storage unit 32, the pulse previous to the current pulse that has been stored.

In some embodiments, referring to FIG. 5E, in a case where the driving sub-circuit 50 includes a plurality of current conversion units 501, a current conversion unit 501 is coupled to a time-delay sub-circuit 40, and each current conversion unit 501 includes a first input terminal $A_{5-1}$, a second input terminal $A_{5-2}$ and an output terminal $B_5$, as shown in FIG. 10, the method further includes:

in S541, in the case where the comparison unit 31 determines that the width of the current pulse is the same as the width of the pulse previous to the current pulse in the control signal, transmitting, by the second output terminal $B_{3-2}$ of the comparison unit 31, the current pulse to the input terminal $A_4$ of the first time-delay sub-circuit 40(1);

in S542, delaying, by each time-delay sub-circuit 40, the current pulse sequentially, transmitting, by a first output terminal $B_{4-1}$ of a former time-delay sub-circuit 40, the delayed current pulse to an input terminal $A_4$ of a latter time-delay sub-circuit 40, and delaying, by the latter time-delay sub-circuit 40, the delayed current pulse again, the delay time of each time-delay sub-circuit 40 being the same;

in S543, transmitting, by the second output terminal $B_{4-2}$ of each time-delay sub-circuit 40, a pulse that is delayed by a different time to a second input terminal $A_{5-2}$ of a current conversion unit 501 coupled to the time-delay sub-circuit 40; and in S544, transmitting, by the output terminal $B_5$ of each current conversion unit 501, a pulse from a time-delay sub-circuit 40 to a corresponding light-emitting device L in the plurality of light-emitting devices L, so as to drive the corresponding light-emitting device L to be turned on or off, and different current conversion units 501 driving different light-emitting devices L to be turned on or off.

In some embodiments, as shown in FIG. 9, the step of receiving, by the comparison sub-circuit 30, the control signal collected by the sampling sub-circuit 20, and determining, by the comparison sub-circuit, whether widths of any two adjacent pulses in the control signal are the same further includes:

in S56, in the case where the comparison unit 31 determines that the width of the current pulse is different from the width of the pulse previous to the current pulse in the control signal, transmitting, by the first output terminal $B_{3-1}$ of the comparison unit 31, the current pulse to the driving sub-circuit 50.

Figure 11:
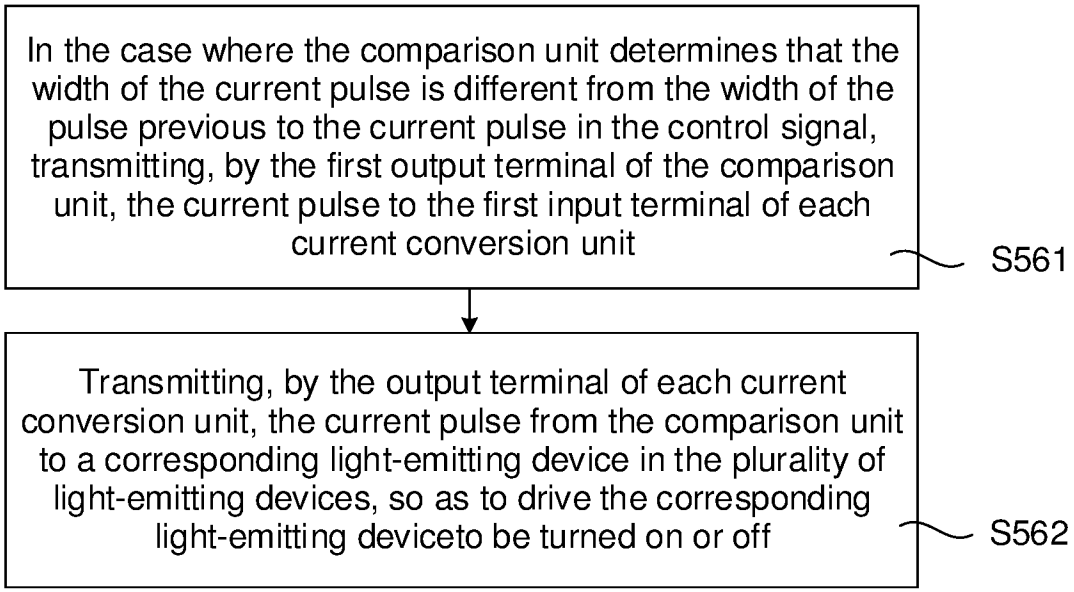
FIG. 11 is a flow diagram of yet another backlight driving method, in accordance with some embodiments.

In some embodiments, referring to FIG. 5E, in the case where the driving sub-circuit 50 includes a plurality of current conversion units 501, and each current conversion unit 501 includes a first input terminal $A_{5-1}$ and an output terminal $B_5$, as shown in FIG. 11, the method further includes:

in S561, in the case where the comparison unit 31 determines that the width of the current pulse is different from the width of the pulse previous to the current pulse in the control signal, transmitting, by the first output terminal $B_{3-1}$ of the comparison unit 31, the current pulse to the first input terminal $A_{5-1}$ of each current conversion unit 501; and in S562, transmitting, by the output terminal $B_5$ of each current conversion unit 501, the current pulse from the comparison unit 31 to a corresponding light-emitting device L in the plurality of light-emitting devices L, so as to drive the corresponding light-emitting device L to be turned on or off.

The above method has the same beneficial effects as the above backlight driving circuit 102, which will not be repeated here.

The forgoing descriptions are merely specific implementation manners of the present disclosure, but the protection scope of the present disclosure is not limited thereto. Any changes or replacements that a person skilled in the art could readily conceive of within the technical scope of the present disclosure shall be included in the protection scope of the present disclosure. Therefore, the protection scope of the present disclosure shall be subject to the protection scope of the claims.

What is claimed is:

1. A backlight driving circuit, comprising:

a pulse width modulator configured to transmit a control signal including a plurality of pulses;

at least one time-delay sub-circuit configured to delay at least one pulse of the control signal from the pulse width modulator that is transmitted to the at least one time-delay sub-circuit by a set time, wherein the at least one time-delay sub-circuit includes a plurality of time-delay sub-circuits coupled in sequence; and each of the plurality of time-delay sub-circuits includes: an input terminal and a second output terminal; and except for a last time-delay sub-circuit, each of the plurality of time-delay sub-circuits further includes: a first output terminal;

an input terminal of a first time-delay sub-circuit is coupled to the pulse width modulator;

in any two adjacent time-delay sub-circuits, a first output terminal of a former time-delay sub-circuit is coupled to an input terminal of a latter time-delay sub-circuit; and the second output terminal of each time-delay sub-circuit is coupled to the driving sub-circuit;

a driving sub-circuit coupled to the at least one time-delay sub-circuit, wherein the driving sub-circuit is configured to drive at least one of a plurality of li ght-emitting devices in a backlight module to be turned on or off according to a control signal from the at least one time-delay sub-circuit obtained after the at least one pulse is delayed;

a sampling sub-circuit coupled to the pulse width modulator; and the sampling sub-circuit is configured to collect the control signal from the pulse width modulator; and a comparison sub-circuit coupled to the sampling sub-circuit and the input terminal of the first time-delay sub-circuit; and the comparison sub-circuit is confi used to receive the control signal collected by the sampling sub-circuit, to determine whether widths of any two adjacent pulses in the control signal are the same, and to transmit a latter pulse in the two adjacent pulses to the input terminal of the first time-delay sub-circuit in a case where it is determined that the widths of the two adjacent pulses are the same.

2. The backlight driving circuit according to claim 1, wherein the last time-delay sub-circuit further includes a first output terminal.

3. The backlight driving circuit according to claim 1, wherein the comparison sub-circuit is further coupled to the driving sub-circuit; and the comparison sub-circuit includes: a comparison unit and a storage unit;

the comparison unit includes: a first input terminal, a second input terminal, a first output terminal and a second output terminal; and the first input terminal of the comparison unit is coupled to the sampling sub-circuit, the second input terminal of the comparison unit is coupled to the storage unit, the first output terminal of the comparison unit is coupled to the driving sub-circuit and the storage unit, and the second output terminal of the comparison unit is coupled to the first time-delay sub-circuit and the storage unit;

the comparison unit is configured to: by the first input terminal of the comparison unit, receive the control signal collected by the sampling sub-circuit, by the second input terminal of the comparison unit, receive a pulse previous to a current pulse in the control signal that has been stored in the storage unit, and determine whether a width of the current pulse is the same as a width of the pulse previous to the current pulse in the control signal; if not, the comparison unit is further configured to output the current pulse by the first output terminal of the comparison unit; and if so, the comparison unit is further configured to output the current pulse by the second output terminal of the comparison unit; and the storage unit is configured to sequentially store pulses of a control signal output from the first output terminal or the second output terminal of the comparison unit, and to make a latter pulse to be stored replace a former pulse that has been stored.

4. The backlight driving circuit according to claim 3, wherein the driving sub-circuit includes a plurality of current conversion units each coupled to one of the plurality of time-delay sub-circuits; and each current conversion unit includes: a first input terminal, a second input terminal and an output terminal; and the first input terminal of the current conversion unit is coupled to the first output terminal of the comparison unit, the second input terminal of the current conversion unit is coupled to a second output terminal of a corresponding time-delay sub-circuit, and the output terminal of the current conversion unit is coupled to the at least one of the plurality of light-emitting devices.

5. The backlight driving circuit according to claim 4, wherein the current conversion unit includes a direct current-direct current (DC-DC) conversion circuit; or the current conversion unit includes an alternating current-direct current (AC-DC) conversion circuit; or the current conversion unit includes a direct current-alternating current (DC-AC) conversion circuit; or the current conversion unit includes an alternating current-alternating current (AC-AC) conversion circuit.

6. The backlight driving circuit according to claim 5, wherein in a case where the current conversion unit includes the DC-DC conversion circuit, delay times of all the time-delay sub-circuits are the same, and a sum of the delay times of all the time-delay sub-circuits is less than or equal to a reciprocal of an operating frequency of the DC-DC conversion circuit.

7. A backlight module, comprising:

the backlight driving circuit according to claim 1; and a plurality of light-emitting devices coupled to the driving sub-circuit in the backlight driving circuit.

8. The backlight module according to claim 7, wherein the driving sub-circuit includes a plurality of current conversion units each including an output terminal;

the plurality of light emitting devices includes a plurality of groups each including at least one light emitting device; and the output terminal of each current conversion unit is coupled to a corresponding group.

9. A display device, comprising:

a display panel; and the backlight module according to claim 7 disposed at a side of the display panel.

10. A backlight driving method applied to the backlight driving circuit according to claim 1, the method comprising:

transmitting, by the pulse width modulator, the control signal including a plurality of pulses;

delaying, by the at least one time-delay sub-circuit, the at least one pulse of the control signal from the pulse width modulator by the set time; and driving, by the driving sub-circuit, the at least one of the plurality of light-emitting devices in the backlight module to be turned on or off according to the control signal from the at least one time-delay sub-circuit obtained after the at least one pulse is delayed;

wherein delaying b the at least one time-delay sub-circuit, the at least one pulse of the control signal from the pulse width modulator by the set time includes:

receiving b the input terminal of the first time-delay sub-circuit, the control signal from the pulse width modulator;

transmitting, by the first output terminal of the former time-delay sub-circuit in any two adjacent time-delay sub-circuits, the control signal obtained after the at least one pulse is delayed by the former time-delay sub-circuit to the input terminal of the latter time-delay sub-circuit; and transmitting, by the second output terminal of each time-delay sub-circuit, the control signal obtained after the at least one pulse is delayed by a corresponding time-delay sub-circuit to the driving sub-circuit:

wherein the method further comprises:

collecting, by the sampling sub-circuit, the control signal including the plurality of pulses from the pulse width modulator: and receiving, by the comparison sub-circuit, the control signal collected by the sampling sub-circuit, and determining, by the comparison sub-circuit, whether widths of any two adjacent pulses in the control signal are the same; and if so, transmitting, by the comparison sub-circuit, the latter pulse in the two adjacent pulses to the input terminal of the first time-delay sub-circuit.

11. The method according to claim 10, wherein the comparison sub-circuit includes: a comparison unit and a storage unit, and the comparison unit includes: a first input terminal, a second input terminal, a first output terminal, and a second output terminal; and receiving, by the comparison sub-circuit, the control signal collected by the sampling sub-circuit, and determining, by the comparison sub-circuit, whether widths of any two adjacent pulses in the control signal are the same; and if so, transmitting, by the comparison sub-circuit, a latter pulse in the two adjacent pulses to the input terminal of the first time-delay sub-circuit includes:

receiving, by the first input terminal of the comparison unit, the control signal collected by the sampling sub-circuit;

receiving, by the second input terminal of the comparison unit, a pulse previous to a current pulse in the control signal that has been stored in the storage unit;

determining, by the comparison unit, whether a width of the current pulse is the same as a width of the pulse previous to the current pulse in the control signal;

if so, transmitting, by the second output terminal of the comparison unit, the currentpulse to the input terminal of the first time-delay sub-circuit; and storing, by the storage unit, the current pulse output by the comparison unit, and deleting, by the storage unit, the pulse previous to the current pulse that has been stored.

12. The method according to claim 11, wherein the driving sub-circuit includes a plurality of current conversion units each coupled to one of the plurality of time-delay sub-circuits, and each current conversion unit includes: a first input terminal, a second input terminal and an output terminal; and the method further comprises:

in a case where the comparison unit determines that the width of the current pulse is the same as the width of the pulse previous to the current pulse in the control signal, transmitting, by the second output, terminal of the comparison unit, the current pulse to the input terminal of the first time-delay sub-circuit;

delaying, by each time-delay sub-circuit, the current pulse sequentially, transmitting, by the first output terminal of the former time-delay sub-circuit, the delayed current pulse to the input terminal of the latter time-delay sub-circuit, and delaying, by the latter time-delay sub-circuit, the delayed current pulse again, a delay time of each time-delay sub-circuit being the same;

transmitting, by the second output terminal of each time-delay sub-circuit, a pulse that is delayed by a different time to a second input terminal of a corresponding current conversion unit; and transmitting, by the output terminal of each current conversion unit, a pulse from a corresponding time-delay sub-circuit to a corresponding light-emitting device in the plurality of light-emitting devices, so as to drive the corresponding light-emitting device to be turned on or off, wherein different current conversion units drive different light-emitting devices in the plurality of light-emitting devices to be turned on or off.

13. The method according to claim 11, wherein receiving, by the comparison sub-circuit, the control signal collected by the sampling sub-circuit, and determining, by the comparison sub-circuit, whether widths of any two adjacent pulses in the control signal are the same further includes:

in a case where the comparison unit determines that the width of the current pulse is different from the width of the pulse previous to the current pulse in the control signal, transmitting, by the first output terminal of the comparison unit, the current pulse to the driving sub-circuit.

14. The method according to claim 13, wherein the driving sub-circuit includes a plurality of current conversion units each coupled to one of the plurality of time-delay sub-circuit, and each current conversion unit includes: a first input terminal and an output terminal and the method further comprises:

in the case where the comparison unit determines that the width of the current pulse is different from the width of the pulse previous to the current pulse in the control signal, transmitting, by the first output terminal of the comparison unit, the current pulse to the first input terminal of each current conversion unit; and transmitting, by the output terminal of each current conversion unit, the current pulse from the comparison unit to a corresponding light-emitting device in the plurality of light-emitting devices, so as to drive the corresponding light-emitting device to be turned on or off.

* * * * *